US008986169B2

(12) United States Patent
Bayerlein et al.

(10) Patent No.: US 8,986,169 B2
(45) Date of Patent: Mar. 24, 2015

(54) MANUAL TREADMILL AND METHODS OF OPERATING THE SAME

(71) Applicant: Woodway USA, Inc., Waukesha, WI (US)

(72) Inventors: Douglas G. Bayerlein, Oconomowoc, WI (US); Vance E. Emons, Hartland, WI (US); Nicholas A. Oblamski, Waukesha, WI (US); Scott D. Hoerig, Brookfield, WI (US); Matthew J. Zank, Milwaukee, WI (US); Robert L. Zimpel, Menomonee Falls, WI (US); Joel W. Richards, Wauwatosa, WI (US)

(73) Assignee: Woodway USA, Inc., Waukesha, WI (US)

( * ) Notice: Subject to any disclaimer, the term of this patent is extended or adjusted under 35 U.S.C. 154(b) by 0 days.

(21) Appl. No.: 14/243,716

(22) Filed: Apr. 2, 2014

(65) Prior Publication Data

US 2014/0213419 A1 Jul. 31, 2014

Related U.S. Application Data

(63) Continuation of application No. 13/235,065, filed on Sep. 16, 2011, which is a continuation-in-part of application No. PCT/US2010/027543, filed on Mar. 16, 2010.

(60) Provisional application No. 61/161,027, filed on Mar. 17, 2009.

(51) Int. Cl.
*A63B 22/02* (2006.01)
*A63B 21/005* (2006.01)

(Continued)

(52) U.S. Cl.
CPC ..... *A63B 22/02* (2013.01); *A63B 21/0053* (2013.01); *A63B 21/157* (2013.01);

(Continued)

(58) Field of Classification Search
CPC . A63B 22/02; A63B 69/0028; A63B 69/0035
USPC ..... 482/2, 23, 37, 51–52, 54–56, 69–71, 482/79; 119/700; 434/247, 255
IPC ..... A63B 22/02
See application file for complete search history.

(56) References Cited

U.S. PATENT DOCUMENTS 219,439 A 9/1879 Blend
1,211,765 A 1/1917 Schmidt (Continued)

FOREIGN PATENT DOCUMENTS

CN 2860541 1/2007
CN 201006229 1/2008

(Continued)

OTHER PUBLICATIONS

Andrews et al., The Effect of an 80-Minute Intermittent Running Protocol on Hamstrings Strength Abstract, NSCA Presentation, Jul. 15, 2006, 1 page.

(Continued)

*Primary Examiner* — Oren Ginsberg
(74) *Attorney, Agent, or Firm* — Foley & Lardner LLP

(57) ABSTRACT

A manually operated treadmill is provided. The treadmill includes a treadmill frame, a front shaft rotatably coupled to the treadmill frame, a rear shaft rotatably coupled to the treadmill frame, a running belt including a contoured running surface upon which a user of the treadmill may run, wherein the running belt is disposed about the front and rear shafts such that force generated by the user causes rotation of the front shaft and the rear shaft and also causes the running belt to rotate about the front shaft and the rear shaft without the rotation of the running belt being generated by a motor, and a one-way bearing assembly configured to prevent rotation of the running surface of the running belt in one direction.

16 Claims, 20 Drawing Sheets

(51) Int. Cl.
*A63B 21/00* (2006.01)
*A63B 22/00* (2006.01)

(52) U.S. Cl.
CPC ..... *A63B22/0285* (2013.01); *A63B 2021/0054* (2013.01); *A63B 2021/0055* (2013.01); *A63B 2022/0017* (2013.01); *A63B 2230/06* (2013.01); *A63B 2230/75* (2013.01)
USPC ..... 482/54

(56) References Cited

U.S. PATENT DOCUMENTS

| | | | |
|---|---|---|---|
| 3,637,206 | A | 1/1972 | Chickering, III |
| 3,642,279 | A | 2/1972 | Cutter |
| 3,968,543 | A | 7/1976 | Shino et al. |
| 4,334,676 | A | 6/1982 | Schonenberger |
| 4,548,405 | A | 10/1985 | Lee et al. |
| 4,614,337 | A | 9/1986 | Schonenberger |
| 4,635,928 | A | 1/1987 | Ogden et al. |
| 4,726,581 | A | 2/1988 | Chang |
| 5,162,988 | A | 11/1992 | Semerau et al. |
| 5,411,279 | A | 5/1995 | Magid |
| 5,470,293 | A | 11/1995 | Schonenberger |
| 5,538,489 | A | 7/1996 | Magid |
| 5,577,598 | A | 11/1996 | Schoenenberger |
| 5,709,632 | A | 1/1998 | Socwell |
| 5,887,579 | A | 3/1999 | Eriksson et al. |
| 5,897,461 | A | 4/1999 | Socwell |
| 6,042,514 | A | 3/2000 | Abelbeck |
| 6,053,848 | A | 4/2000 | Eschenbach |
| 6,095,952 | A | 8/2000 | Ali et al. |
| 6,146,315 | A | 11/2000 | Schonenberger |
| 6,348,025 | B1 | 2/2002 | Schonenberger |
| 6,500,097 | B1 | 12/2002 | Hall |
| 6,740,009 | B1 | 5/2004 | Hall |
| 7,090,620 | B1 | 8/2006 | Barlow |
| 7,560,822 | B1 | 7/2009 | Hoffmann |
| 7,717,828 | B2 | 5/2010 | Simonson et al. |
| 8,308,619 | B1 | 11/2012 | Astilean |
| 8,343,016 | B1 | 1/2013 | Astilean |
| 2002/0147079 | A1 | 10/2002 | Kalnbach |
| 2006/0003871 | A1 | 1/2006 | Houghton et al. |
| 2006/0003872 | A1 | 1/2006 | Chiles et al. |
| 2006/0287165 | A1 | 12/2006 | Pasqualin |
| 2008/0287266 | A1 | 11/2008 | Smith |
| 2009/0170666 | A1 | 7/2009 | Chiang |
| 2009/0215589 | A1 | 8/2009 | Schoenenberger |
| 2009/0280960 | A1 | 11/2009 | Tian |
| 2011/0266091 | A1 | 11/2011 | Taylor |
| 2012/0157267 | A1 | 6/2012 | Lo |
| 2012/0231934 | A1 | 9/2012 | Lo |
| 2012/0270705 | A1 | 10/2012 | Lo |

FOREIGN PATENT DOCUMENTS

| | | | |
|---|---|---|---|
| CN | 201030178 | | 3/2008 |
| DE | 1020050 09 414 | | 9/2006 |
| EP | 1 466 651 | A1 | 10/2004 |
| JP | 3148743 | | 2/2009 |
| KR | 2009007043 | | 1/2009 |
| WO | WO 2010/057238 | A2 | 5/2010 |

OTHER PUBLICATIONS

Brughelli et al., Effects of Running Velocity on Running Kinetics and Kinematics, Journal of Strength and Conditioning Research, Apr. 2011, 7 pages.
Complaint for Declaratory Judgment of Patent Invalidity and Correction of Inventorship, *Woodway USA, Inc.* v. *Aurel A. Astilean,* Civ. Dkt. No. 2:13-cv-00681-WEC (E.D. WI), Jun. 13, 2013, 6 pages.
Curvature, http://en.wikipedia.org/wiki/Curvature, Mar. 3, 2010, 1 page.
Decision and Order Denying Defendant's Motion to Dimiss or to Transfer and Staying Case Pending Decision from Eastern District New York District Court, *Woodway USA, Inc.* v. *Aurel A. Astilean,* Civ. Dkt. No. 2:13-cv-00681-WEC (E.D. WI), Dec. 18, 2013, 7 pages.
Docket Report, *Speedfit LLC and Aurel A. Astilean* v. *Douglas G. Bayerlain,* Civ. Dkt. No. 2:13-cv-01276-KAM-AKT (E.D.N.Y.), Dec. 19, 2013, 8 pages.
Docket Report, *Woodway USA, Inc.* v. *Aurel A. Astilean,* Civ. Dkt. No. 2:13-cv-00681-WEC (E.D. WI), Dec. 19, 2013, 3 pages.
EMS-Grivory Grivory GV-5H Black 9915 Nylon Copolymer, 50% Glass Fiber Filled, As Conditioned, believed to be publically available before Sep. 16, 2011, 2 pages.
First Amended Complaint (Jury Trial Demanded), *Speedfit LLC and Aurel A. Astilean* v. *Douglas G. Bayerlein,* Civ. Dkt. No. 2:13-cv-01276-KAM-AKT (E.D.N.Y.), Jun. 17, 2013, 16 pages.
Hall, The Rotary Treadwheel, 1 page.
Hersher, Perfect Landing, http://news.harvard.edu/gazette/story/2010/01/different-strokes/, Jan. 27, 2010, 5 pages.
Hersher, Perfect Landing, http://news.harvard.edu/gazette/story/2010/01/different-strokes/, Feb. 26, 2010, 5 pages.
Hopker et al., Familiarisation and Reliability of Sprint Test Indices During Laboratory and Field Assessment, Journal of Sports Science and Medicine, Dec. 1, 2009, 5 pages.
Integrated Performance Systems, LLC, Conditioning in a Professional Athlete Case Study, 2005, 1 page.
Integrated Performance Systems, LLC, Lower Extremity Rehabilitation & Assessment Case Study, 2005, 2 pages.
Integrated Performance Systems, LLC, Youth Athlete-Speed Training Case Study, 2005, 2 pages.
International Preliminary Report for Application No. PCT/US2010/026731, mail date Sep. 29, 2011, 7 pages.
International Preliminary Report for Application No. PCT/US2010/027543, mail date Sep. 29, 2011, 9 pages.
International Search Report and Written Opinion for Application No. PCT/US2010/026731, mail date May 4, 2010, 8 pages.
International Search Report and Written Opinion for Application No. PCT/US2010/027543, mail date May 12, 2010, 10 pages.
Introducing the New Force 3 Treadmill Advanced Analysis Package, www.fittech.com.au, believed to be publically available before Sep. 16, 2011, 3 pages.
Lieberman et al., Running Barefoot, Forefoot Striking & Training Tips, http://www.barefootrunning.fas.harvard.edu/5BarefootRunning&TrainingTips.html, Feb. 26, 2010, 5 pages.
Lieberman et al., Running Barefoot: Biomechanics of Foot Strike, http://www.barefootrunning.fas.harvard.edu/4Biomechanicsof-FootStrike.html, Feb. 26, 2010, 6 pages.
Lieberman et al., Running Barefoot: Biomechanics of Foot Strikes & Applications to Running Barefoot or in Minimal Footwear, http://www.barefootrunning.fas.harvard.edu/index.html, Feb. 26, 2010, 2 pages.
Lieberman et al., Running Barefoot: FAQ, http://www.barefootrunning.fas.harvard.edu/6FAQ.html, Feb. 26, 2010, 3 pages.
Lieberman et al., Running Barefoot: Heel Striking & Running Shoes, http://www.barefootrunning.fas.harvard.edu/2FootStrikes&RunningShoes.html, Feb. 26, 2010, 2 pages.
Lieberman et al., Running Barefoot: Running Before the Modern Shoe, http://www.barefootrunning.fas.harvard.edu/3RunningBeforeTheModernShoe.html, Feb. 26, 2010, 4 pages.
Lieberman et al., Running Barefoot: Why Consider Foot Strike, http://www.barefootrunning.fas.harvard.edu/1WhyConsiderFootStrike.html, Feb. 26, 2010, 1 page.
Moody, The Effects Resisted Sprint Training on Speed, Agility and Power Production in Young Athletes, believed to be publically available before Dec. 31, 2006, 5 pages.
Nexus Resin Group, 10124 Antistat, believed to be publically available before Sep. 16, 2011, 2 pages.
Owners Manual, Force 1, Nov. 29, 2007, 44 pages.
Owners Manual, Force 3, Jan. 28, 2009, 45 pages.
Owners Manual, The Force, Dec. 18, 2008, 68 pages.
Plantar Fascia, http://en.wikipedia.org/wiki/Plantar_fascia, Mar. 3, 2010, 3 pages.
Ross et al., The Effects of Treadmill Sprint Training and Resistance Training on Maximal Running Velocity and Power, National Strength and Conditioning Association, Mar. 2009, 10 pages.

(56) References Cited

OTHER PUBLICATIONS

Sirotic et al., Physiological and Performance Test Correlates of Prolonged, High-Intensity, Intermittent Running Performance in Moderately Trained Women Team Sport Athletes, Journal of Strength and Conditioning Research, 2007, 7 pages.
Sirotic et al., The Reliability of Physiological and Performance Measures During Simulated Team-Sport Running on a Non-Motorised Treadmill, Journal of Science and Medicine in Sport, Apr. 11, 2007, 10 pages.
Soccer International, The Red Devil's in the Details, dated Jun. 2010, 4 pages.
The Woodway Force Brochure, The Best Way to Train for Speed & Athletic Power, dated May 5, 2005, 2 pages.
Woodway, Curve 3.0 Specification, May 25, 2011, 1 page.
Woodway, Curve Specification, May 24, 2011, 1 page.
Woodway, Curve Specification, May 25, 2011, 1 page.
Woodway, Curve XL Specification, May 18, 2011, 1 page.
Woodway, Force Specification, Apr. 8, 2008, 1 page.
Woodway, Force Specification, May 2, 2011, 1 page.
Woodway, Force Specification, May 2, 2012, 1 page.
Woodway's Opposition to Defendant's Notice of Motion and Motion to Dismiss Case and Transfer Litigation to EDNY, *Woodway USA, Inc.* v. *Aurel A. Astilean,* Civ. Dkt. No. 2:13-cv-00681-WERC (E.D. WI), Oct. 18, 2013, 22 pages.

MANUAL TREADMILL AND METHODS OF OPERATING THE SAME

CROSS-REFERENCE TO RELATED PATENT APPLICATIONS

This application claims the benefit of priority as a continuation of U.S. patent application Ser. No. 13/235,065, filed Sep. 16, 2011, which is a continuation-in-part of prior international Application No. PCT/US10/27543, filed Mar. 16, 2010, which claims priority to U.S. Provisional Application Ser. No. 61/161,027, filed Mar. 17, 2009, all of which are incorporated herein by reference in their entireties.

BACKGROUND

The present invention relates generally to the field of treadmills. More specifically, the present invention relates to manual treadmills. Treadmills enable a person to walk, jog, or run for a relatively long distance in a limited space. It should be noted that throughout this document, the term "run" and variations thereof (e.g., running, etc.) in any context is intended to include all substantially linear locomotion by a person. Examples of this linear locomotion include, but are not limited to, jogging, walking, skipping, scampering, sprinting, dashing, hopping, galloping, etc.

A person running generates force to propel themselves in a desired direction. To simplify this discussion, the desired direction will be designated as the forward direction. As the person's feet contact the ground (or other surface), their muscles contract and extend to apply a force to the ground that is directed generally rearward (i.e., has a vector direction substantially opposite the direction they desire to move). Keeping with Newton's third law of motion, the ground resists this rearwardly directed force from the person, resulting in the person moving forward relative to the ground at a speed related to the force they are creating.

To counteract the force created by the treadmill user so that the user stays in a relatively static fore and aft position on the treadmill, most treadmills utilize a belt that is driven by a motor. The motor operatively applies a rotational force to the belt, causing that portion of the belt on which the user is standing to move generally rearward. This force must be sufficient to overcome all sources of friction, such as the friction between the belt and other treadmill components in contact therewith and kinetic friction, to ultimately rotate the belt at a desired speed. The desired net effect is that, when the user is positioned on a running surface of the belt, the forwardly directed velocity achieved by the user is substantially negated or balanced by the rearwardly directed velocity of the belt. Stated differently, the belt moves at substantially the same speed as the user, but in the opposite direction. In this way, the user remains at substantially the same relative position along the treadmill while running. It should be noted that the belts of conventional, motor-driven treadmills must overcome multiple, significant sources of friction because of the presence of the motor and configurations of the treadmills themselves.

Similar to a treadmill powered by a motor, a manual treadmill must also incorporate some system or means to absorb or counteract the forward velocity generated by a user so that the user may generally maintain a substantially static position on the running surface of the treadmill. The counteracting force driving the belt of a manual treadmill is desirably sufficient to move the belt at substantially the same speed as the user so that the user stays in roughly the same static position on the running surface. Unlike motor-driven treadmills, however, this force is not generated by a motor.

SUMMARY

One embodiment of the disclosure relates to a manually operated treadmill comprising a treadmill frame having a front end and a rear end opposite the front end, a front shaft rotatably coupled to the treadmill frame at the front end, a rear shaft rotatably coupled to the treadmill frame at the rear end, a running belt including a curved running surface upon which a user of the treadmill may run, and a one-way bearing assembly coupled to at least one of the front shaft and the rear shaft, wherein the one-way bearing assembly prevents rotation of at least one of the front shaft and the rear shaft in one direction and permits rotation of at least one of the front shaft and the rear shaft in the opposite direction to restrict rotation of the running belt in a single direction. The running belt is disposed about the front and rear shafts such that force generated by the user causes rotation of the front shaft and the rear shaft and also causes the running surface of the running belt to move from the front shaft toward the rear shaft. The treadmill is configured to allow the user to manually control the speed of the running belt and to facilitate maintenance of a contour of the curved running surface.

Another embodiment of the disclosure relates to a manually operated treadmill comprising a treadmill frame, a front shaft rotatably coupled to the treadmill frame, a rear shaft rotatably coupled to the treadmill frame, a running belt including a contoured running surface upon which a user of the treadmill may run, wherein the running belt is disposed about the front and rear shafts such that force generated by the user causes rotation of the front shaft and the rear shaft and also causes the running belt to rotate about the front shaft and the rear shaft without the rotation of the running belt being generated by a motor, and a one-way bearing assembly configured to prevent rotation of the running surface of the running belt in one direction.

Another embodiment of the disclosure relates to a manually operated treadmill comprising a frame supported on a substantially horizontal surface, a front shaft assembly supported by the frame and comprising a front shaft and at least one front running belt pulley supported by the front shaft, a rear shaft assembly supported by the frame a spaced distance from the front shaft and comprising a rear shaft and at least one rear running belt pulley supported by the rear shaft, a running belt supported at least in part by the front shaft assembly and the rear shaft assembly, and a one-way bearing assembly cooperating with one of the front shaft and the rear shaft to permit rotation of said one of the front shaft and the rear shaft in only one direction. The running belt includes a front portion adjacent the front shaft assembly, a rear portion adjacent the rear shaft assembly, and a central portion intermediate the front portion and the rear portion, the front portion and the rear portion being positioned vertically higher than a lowest point found in the central portion to form a non-planar running surface upon which a user of the treadmill may walk or run, wherein gravitational force acting upon weight of the user's body on the running belt relative to the lowest point of the running belt causes rotation of the running belt, front shaft, and the rear shaft without the aid of a motor.

Another embodiment of the disclosure relates to a manually operated treadmill comprising a treadmill frame having a front end and a rear end opposite the front end, a front shaft rotatably coupled to the treadmill frame at the front end, a rear shaft rotatably coupled to the treadmill frame at the rear end, and a running belt including a curved running surface upon which a user of the treadmill may run. The running belt is disposed about the front and rear shafts such that force generated by the user causes rotation of the front shaft and the rear shaft and also causes the running surface of the running belt to move from the front shaft toward the rear shaft. The treadmill is configured to control the speed of the running belt to facilitate the maintenance of the contour of the curved running surface.

Another embodiment of the disclosure relates to a manually operated treadmill comprising a treadmill frame, a front support member rotatably coupled to the treadmill frame, a rear support member rotatably coupled to the treadmill frame, a running belt including a curved running surface upon which a user of the treadmill may run, wherein the running belt is supported by the front support member and the rear support member, and a synchronizing system configured to cause the front support member and the rear support member to rotate at substantially the same speeds. The force generated by the user causes rotation of the front support member and the rear support member and also causes the running belt to rotate relative to the treadmill frame.

Another embodiment of the disclosure relates to manually operated treadmill comprising a treadmill frame, a running belt including a running surface upon which a user of the treadmill may run, a front support member rotatably coupled to the treadmill frame, the front support member comprising the forwardmost support for the running belt, a rear support member rotatably coupled to the treadmill frame, the rear support member comprising the rearwardmost support for the running belt. The running surface comprises at least in part a complex curve located intermediate the front support member and the rear support member and incorporating a minimum of two geometric configurations.

DETAILED DESCRIPTION

Figure 1:
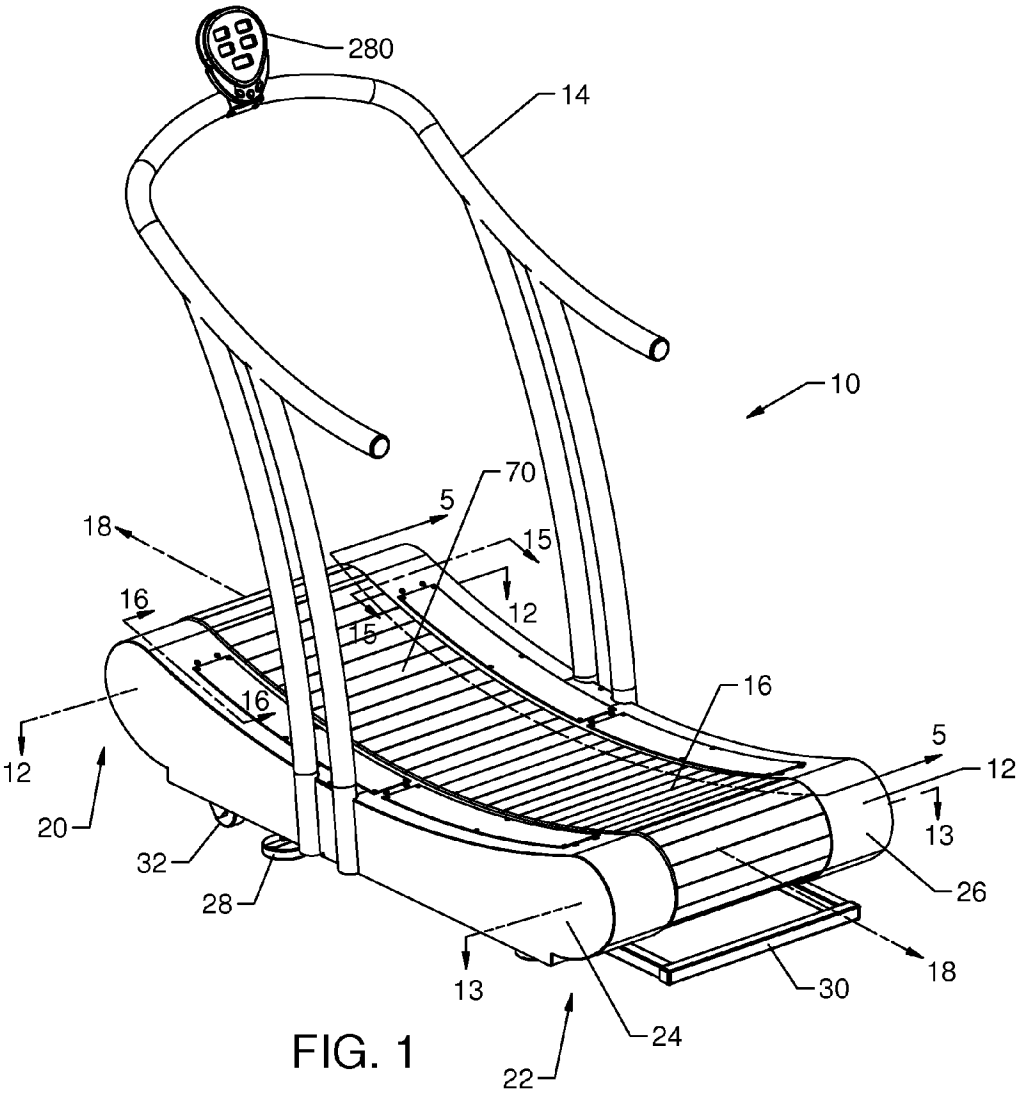
FIG. 1 is a perspective view of an exemplary embodiment of a manual treadmill having a non-planar running surface.

Referring to FIG. 1, a manual treadmill 10 generally comprises a base 12 and a handrail 14 mounted to the base 12 as shown according to an exemplary embodiment. The base 12 includes a running belt 16 that extends substantially longitudinally along a longitudinal axis 18. The longitudinal axis 18 extends generally between a front end 20 and a rear end 22 of the treadmill 10; more specifically, the longitudinal axis 18 extends generally between the centerlines of a front shaft and a rear shaft, which will be discussed in more detail below.

A pair of side panels 24 and 26 (e.g., covers, shrouds, etc.) are preferably provided on the right and left sides of the base 12 to effectively shield the user from the components or moving parts of the treadmill 10. The base 12 is supported by multiple support feet 28, which will be described in greater detail below. A rearwardly extending handle 30 is provided on the rear end of the base 12 and a pair of wheels 32 are provided at the front of the base 12, however, the wheels 32 are mounted so that they are generally not in contact with the ground when the treadmill is in an operating position. The user can easily move and relocate the treadmill 10 by lifting the rear of the treadmill base 12 a sufficient amount so that the multiple support feet 28 are no longer in contact with the ground, instead the wheels 32 contact the ground, thereby permitting the user to easily roll the entire treadmill 10. It should be noted that the left and right-hand sides of the treadmill and various components thereof are defined from the perspective of a forward-facing user standing on the running surface of the treadmill 10.

Referring to FIGS. 2-6, the base 12 is shown further including a frame 40, a front shaft assembly 44 positioned near a front end 48 of the frame 40, and a rear shaft assembly 46 positioned near the rear end 50 of frame 40, generally opposite the front end 48. Specifically, the front shaft assembly 44 is coupled to the frame 40 at the front end 48, and the rear shaft assembly 46 is coupled to the frame 40 at the rear end 50 so that the frame supports these two shaft assemblies.

The frame 40 comprises longitudinally-extending, opposing side members, shown as a left-hand side member 52 and a right-hand side member 54, and one or more lateral or cross-members 56 extending between and structurally connecting the side members 52 and 54 according to an exemplary embodiment. Each side member 52, 54 includes an inner surface 58 and an outer surface 60. The inner surface 58 of the left-hand side member 52 is opposite to and faces the inner surface 58 of the right-hand side member 54. According to other exemplary embodiments, the frame may have substantially any configuration suitable for providing structure and support for the manual treadmill.

Similar to most motor-driven treadmills, the front shaft assembly 44 includes a pair of front running belt pulleys 62 interconnected with, and preferably directly mounted to, a shaft 64, and the rear shaft assembly 46 includes a pair of rear running belt pulleys 66 interconnected with, and preferably directly mounted to, a shaft 68. The front and rear running belt pulleys 62, 66 are configured to facilitate movement of the running belt 16. The running belt 16 is disposed about the front and rear running belt pulleys 62, 66, which will be discussed in more detail below. As the front and rear running belt pulleys 62, 66 are preferably fixed relative to shafts 64 and 68, respectively, rotation of the front and rear running belt pulleys 62, 66 causes the shafts 64, 68 to rotate in the same direction. The front and rear running belt pulleys 62, 66 are formed of a material sufficiently rigid and durable to maintain shape under load. Preferably, the material is of a relatively light weight so as to reduce the inertia of the pulleys 62, 66. The pulleys 62, 66 may be formed of any material having one or more of these characteristics (e.g., metal, ceramic, composite, plastic, etc.). According to the exemplary embodiment shown, the front and rear running belt pulleys 62, 66 are formed of cast aluminum. According to another embodiment, the front and rear running belt pulleys 62, 66 are formed of a glass-filled nylon, for example, Grivory® GV-5H Black 9915 Nylon Copolymer available from EMS-GRIVORY of Sumter, S.C. 29151, which may save cost and reduce the weight of the pulleys 62, 66 relative to metal pulleys. To prevent a static charge due to operation of the treadmill 10 from building on a pulley 62, 66 formed of electrically insulative materials (e.g., plastic, composite, etc.), an antistatic additive, for example Antistat 10124 from Nexus Resin Group of Mystic, Conn. 06355, maybe may be blended with the GV-5H material.

As noted above, the manual treadmill disclosed herein includes a force translation system that incorporates a variety of innovations to translate the forward force created by the user into rotation of the running belt and permit the user to maintain a substantially static fore and aft position on the running belt while running. One of the ways to translate this force is to configure the running belt 16 to be more responsive to the force generated by the user. For example, by minimizing the friction between the running belt 16 and the other relevant components of the treadmill 10, more of the force the user applies to the running belt 16 to propel themselves forward can be utilized to rotate the running belt 16.

Another way to counteract the user-generated force and convert or translate it into rotational motion of the running belt 16 is to integrate a non-planar running surface, such as non-planar running surface 70. Depending on the configuration, non-planar running surfaces can provide a number of advantages. First, the shape of the non-planar running surface may be such that, when a user is on the running surface, the force of gravity acting upon the weight of the user's body helps rotate the running belt. Second, the shapes may be such that it creates a physical barrier to restrict or prevent the user from propelling themselves off the front end 20 of the treadmill 10 (e.g., acting essentially as a stop when the user positions their foot thereagainst, etc.). Third, the shapes of some of the non-planar running surfaces can be such that it facilitates the movement of the running belt 16 there along (e.g., because of the curvature, etc). Accordingly, the force the user applies to the running belt is more readily able to be translated into rotation of the running belt 16.

Figure 4:
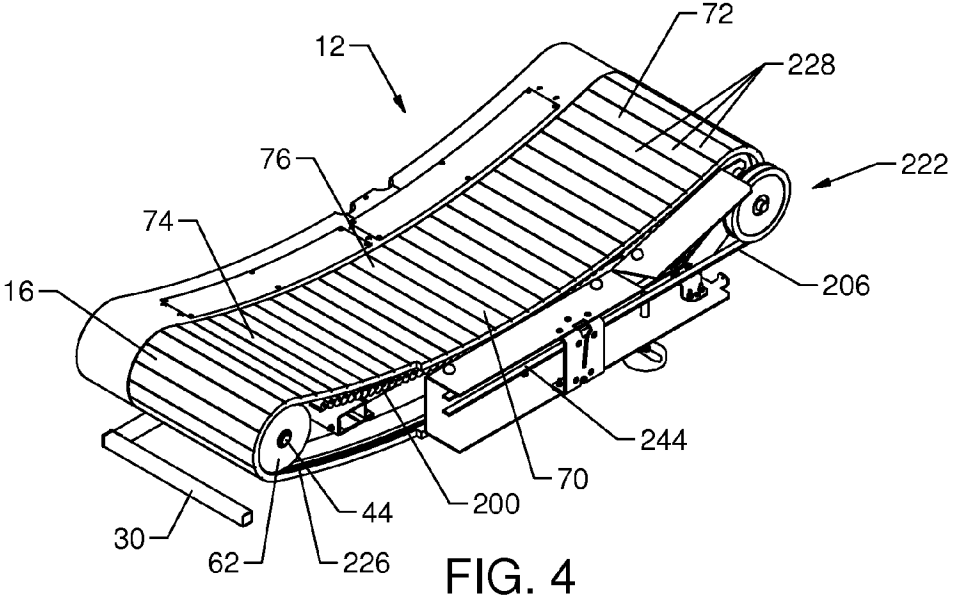
FIG. 4 is a perspective view of the right-hand side of the manual treadmill of FIG. 1 with a portion of the rear of the treadmill cut-away to show a portion of the arrangement of elements.
Figure 5:
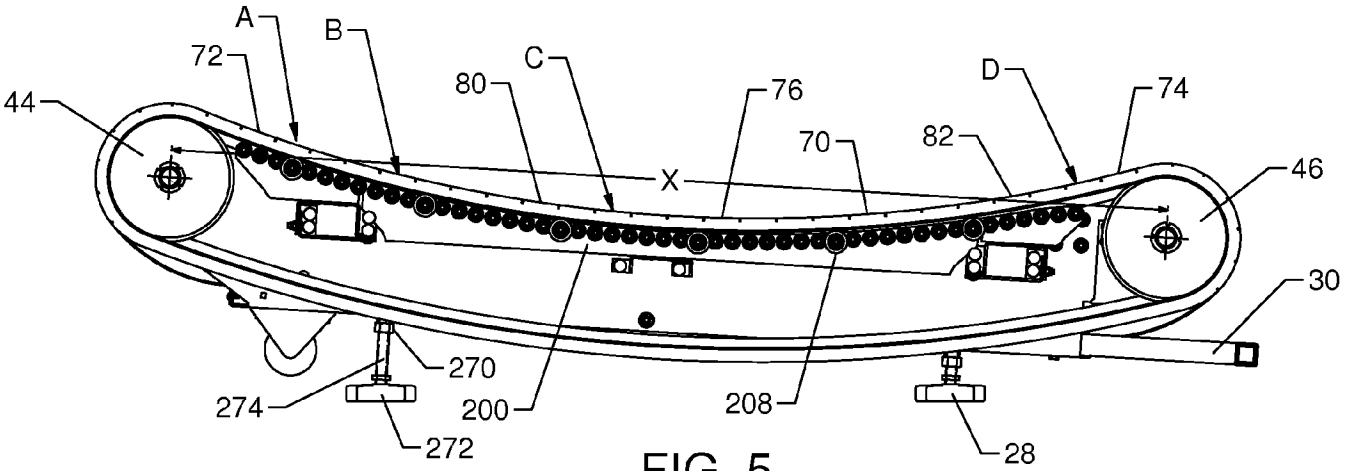
FIG. 5 is a cross-sectional view of a portion of the manual treadmill taken along line 5-5 of FIG. 1.

As seen in FIGS. 1 and 4-5, the running surface 70 is generally non-planar and shown shaped as a substantially complex curve according to an exemplary embodiment. The running surface can be generally divided up into three general regions each having a particular geometric configuration, the front portion 72, which is adjacent to the front shaft assembly 44, the rear portion 74, which is adjacent to the rear shaft assembly 46, and the central portion 76, which is intermediate the front portion 72 and the rear portion 74. In the exemplary embodiment seen in FIGS. 1 and 4, the running surface 70 includes a substantially concave curve 80 and a substantially convex curve 82. At the front portion 72 of the running surface 70, the relative height or distance of the running surface 70 relative to the ground is generally increasing moving forward along the longitudinal axis 18 from the central portion 76 toward the front shaft assembly 44. This increasing height configuration provides one structure to translate the forward running force generated by the user into rotation of the running belt 16. To initiate the rotation of the running belt 16, the user places her first foot at some point along the upwardly-inclined front portion 72 of the running surface 70. As the weight of the user is transferred to this first foot, gravity exerts a downward force on the user's foot and causes the running belt 16 to move (e.g., rotate, revolve, advance, etc.) in a generally clockwise direction as seen in FIG. 1 (or counter-clockwise as seen in FIG. 4). As the running belt 16 rotates, the user's first foot will eventually reach the lowest point in the non-planar running surface 70 found in the central portion 76, and, at that point, gravity is substantially no longer available as a counteracting source to the user's forward running force. Assuming a typical gait, at this point the user will place her second foot at some point along the upwardly-inclined front portion 72 of the running belt 16 and begin to transfer weight to this foot. Once again, as weight shifts to this second foot, gravity acts on the user's foot to continue the rotation of the running belt 16 in the clockwise direction as seen in FIG. 1. This process merely repeats itself each and every time the user places her weight-bearing foot on the running belt 16 at any position vertically above the lowest point of central portion 76 of the running surface 70 of the of the running belt 16. The upwardly-inclined front portion 72 of the running belt 16 also acts substantially as a physical stop, reducing the chance the user can inadvertently step off the front end 20 of the treadmill 10.

A user can generally utilize the force translation system of the treadmill 10 to control the speed of the treadmill 10 by the relative placement of her weight-bearing foot along the running belt 16 of the base 12. Generally, the rotational speed of the running belt 16 increases as greater force is applied thereto in the rearward direction. The generally upward-inclined shape of the front portion 72 thus provides an opportunity to increase the force applied to the running belt 16, and, consequently, to increase the speed of the running belt 16. For example, by increasing her stride and/or positioning her weight-bearing foot vertically higher on the front portion 72 relative to the lowest portion of the running belt 16, gravity will exert a greater and greater amount of force on the running belt 16 to drive it rearwardly. In the configuration of the running belt 16 seen in FIG. 1, this corresponds to the user positioning her foot closer to the front end 20 of the treadmill 10 along the longitudinal axis 18. This results in the user applying more force to the running belt 16 because gravity is pulling her mass downward along a greater distance when her feet are in contact with the front portion 72 of the running surface 70. As a result, the relative rotational speed of the running belt 16 and the relative running speed the user experiences is increased. Accordingly, the force translation system is adapted to convert a variable level of force generated by the user into a variable speed of rotation of the belt.

FIG. 5 illustrates a number of possible locations where a user may position her feet. A-C indicate locations along the front portion 72 of the running surface 70 where a user may place their weight bearing foot. When the user positions her weight bearing foot at location A, she will be running with greater speed than if her weight bearing foot was positioned at locations B or C based upon the fact that the force of gravity is able to have a greater effect as the user's weight bearing foot moves from location A towards the rear of the non-planar running surface 70 as the running belt 16 rotates. At location A, gravity is able to have the greatest impact on the user so that the greatest amount of force is translated into rotation of the running belt 16. A user can decrease her relative running speed by positioning her weight bearing foot at locations B or C. As location B is relatively higher along the front portion 72 than C, gravity is able to exert a greater force on the user and the running belt 16 than if the user's weight bearing foot was positioned at location C.

Another factor which will increase the speed the user experiences on the treadmill 10 is the relative cadence the user assumes. As the user increases her cadence and places her weight-bearing foot more frequently on the upwardly extending front portion 72, more gravitational force is available to counteract the user-generated force, which translates into greater running speed for the user on the running belt 16. It is important to note that speed changes in this embodiment are substantially fluid, substantially instantaneous, and do not require a user to operate electromechanical speed controls. The speed controls in this embodiment are generally the user's cadence and relative position of her weight-bearing foot on the running surface. In addition, the user's speed is not limited by speed settings as with a driven treadmill.

In the embodiment shown in FIGS. 1-6, gravity is also utilized as a means for slowing the rotational speed of the running belt. At a rear portion 74 of the running surface 70, the distance of the running surface 70 relative to the ground generally increases moving rearward along the longitudinal axis 18 from the lowest point in the non-planar running surface 70. As each of the user's feet move rearward during her stride, the rear portion 74 acts substantially as a physical stop to discourage the user from moving too close to the rear end of the running surface. To this point, the user's foot has been gathering rearward momentum while moving from the front portion 72, into the central portion 76, and toward the rear portion 74 of the running surface 70. Accordingly, the user's foot is exerting a significant rearwardly-directed force on the running belt 16. Under Newton's first law of motion, the user's foot would like to continue in the generally rearward direction. The upwardly-inclined rear portion 74, interferes with this momentum and provides a force to counter the rearwardly-directed force of the user's foot by providing a physical barrier. As the user's non-leading foot moves up the incline (see position D in FIG. 5), the running surface 70 provides a force that counters the force of the user's foot, absorbing some of the rearwardly-directed force from the user and preventing it from being translated into increasing speed of the running belt 16. Also, gravity acts on the user's weight bearing foot as it moves upward, exerting a downwardly-directed force on the user's foot that the user must counter to lift their foot and bring it forward to continue running. In addition to acting as a stop, the rear portion 74 provides a convenient surface for the user to push off of when propelling themselves forward, the force applied by the user to the rear portion 74 being countered by the force the rear portion 74 applies to the user's foot.

One benefit of the manual treadmill according to the innovations described herein is positive environmental impact. A manual treadmill such as that disclosed herein does not utilize electrical power to operate the treadmill or generate the rotational force on the running belt. Therefore, such a treadmill can be utilized in areas distant from an electrical power source, conserve electrical power for other uses or applications, or otherwise reduce the "carbon footprint" associated with the operation of the treadmill 10.

Figure 7A:
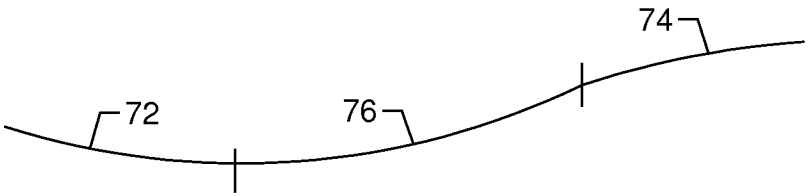
FIG. 7*a* is a side schematic view of the profile of the running surface of the manual treadmill according to an exemplary embodiment.

A manual treadmill according to the innovations disclosed herein can incorporate one of a variety of shapes and complex contours in order to translate the user's forward force into rotation of the running belt or to provide some other beneficial feature or element. FIG. 7*a* generally depicts the curve defined by the running surface 70 of the exemplary embodiment shown in FIG. 1, specifically, substantially a portion of a curve defined by a third-order polynomial. The front portion 72 and the central portion 76 define a concave curve and the rear portion 74 of the running surface 70 defines a convex curve. As the central portion 76 of the running surface 70 transitions to the rear portion 74, the concave curve transitions to the convex curve. In the embodiment shown, the curvature of the front portion 72 and the central portion 76 is substantially the same; however, according to other exemplary embodiments, the curvature of the front portion 72 and the central portion 76 may differ. Please note, the description of the running surfaces as concave and convex provided herein is related to the relative curve which the user's foot would experience on the running surface 70.

Figure 7B:
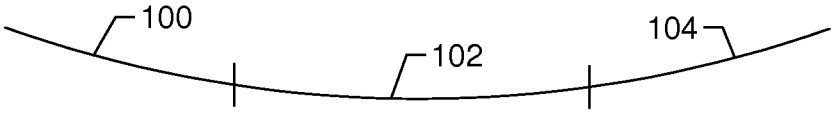
FIGS. 7*b*-7*j* are sides schematic views of alternative profiles of the running surfaces of manual treadmills according to alternative exemplary embodiments.

FIGS. 7*b*-7*h* illustrate the side profiles of some exemplary non-planar, contoured running surfaces according to the innovations disclosed herein, each including a front portion, a central portion, and a rear portion. Each portion has a particular geometric configuration that is concave, convex, or linear; collectively, the portions define the non-planar running surface. For example, FIG. 7*b* shows an exemplary embodiment of the profile of a non-planar surface including a concave front portion 100, a concave central portion 102, and a concave rear portion 104 according to an exemplary embodiment. In this embodiment, the front portion 100, central portion 102, and rear portion 104 each have different curvatures. According to other exemplary embodiments, one or more of the front, central, and rear portions may have the same curvature.

Figure 7C:
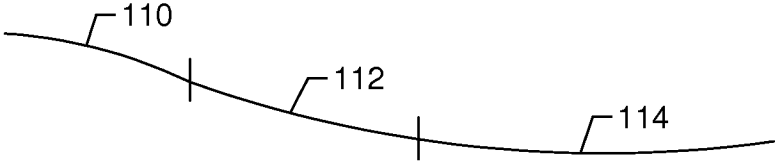

FIG. 7*c* shows an exemplary embodiment of the profile of a non-planar surface including a convex front portion 110, a concave central portion 112, and a concave rear portion 114 according to an exemplary embodiment. Once again, this embodiment incorporates a smooth transition between the different curvatures of the front, central, and rear portions.

Figure 7D:
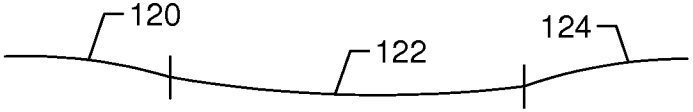

FIG. 7*d* shows an exemplary embodiment of the profile of a non-planar surface including a convex front portion 120, a concave central portion 122, and a convex rear portion 124 according to an exemplary embodiment. In this embodiment, the front portion 120 and the rear portion 122 have different curvatures, but these curvatures may be the same according to other exemplary embodiments.

Figure 7E:
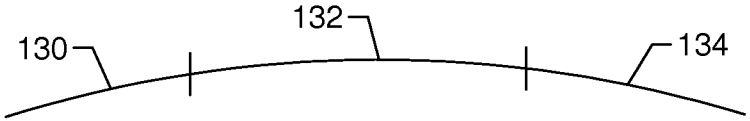

FIG. 7*e* shows an exemplary embodiment of the profile of a non-planar surface including a convex front portion 130, a convex central portion 132, and a convex rear portion 134 according to an exemplary embodiment. In this embodiment, the front portion 130, the central portion 132, and the rear portion 134 each have the same convex curvature, but the curvature of one of more of the front portion 130, the central portion 132, and the rear portion 134 may differ according to other exemplary embodiments.

Figure 7F:
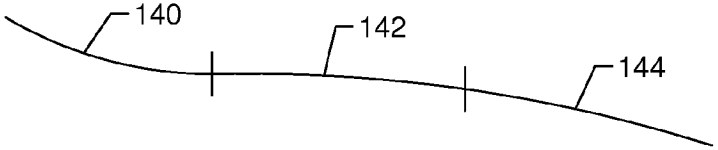

FIG. 7*f* shows an exemplary embodiment of the profile of a non-planar surface including a concave front portion 140, a convex central portion 142, and a convex rear portion 144 according to an exemplary embodiment. In this embodiment, the central portion 142 and the rear portion 144 having the same curvatures, but these curvatures may differ from each other according to other exemplary embodiments.

Figure 7G:
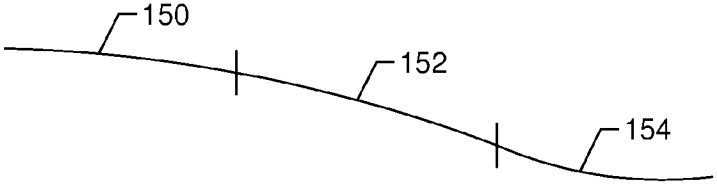

FIG. 7*g* shows an exemplary embodiment of the profile of a non-planar surface including a convex front portion 150, a convex central portion 152, and a concave rear portion 154 according to an exemplary embodiment. In this embodiment, the front portion 150 and the central portion 152 having the same curvatures, but these curvatures may differ from each other according to other exemplary embodiments.

Figure 7H:
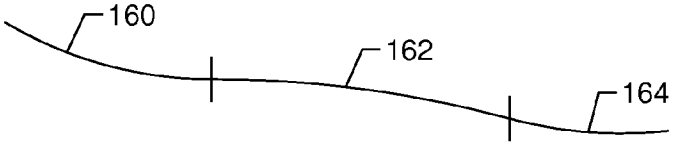

FIG. 7*h* shows an exemplary embodiment of the profile of a non-planar surface including a concave front portion 160, a convex central portion 162, and a concave rear portion 164 according to an exemplary embodiment. In this embodiment, the front portion 160 and the rear portion 164 have different curvatures, but these curvatures may be the same according to other exemplary embodiments.

Figure 7I:
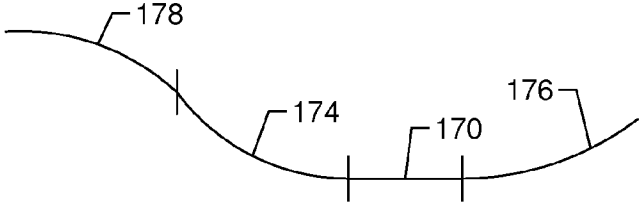

According to one exemplary embodiment, the non-planar running surface of the manual treadmill 10 is substantially curved, but that curve integrates one or more linear portions (e.g., that replace a "curved portion" or the curve or that are added/inserted into the curve). The linear portions may be substantially parallel to the longitudinal axis 18 or disposed at an angle relative thereto. FIG. 7*i* illustrates the profile of a non-planar surface wherein a substantially linear portion 170 has been integrated with a concave curve having a first concave portion 174 to one side of the linear portion 170 and a second concave portion 176 to the opposite side of the linear portion 170 according to an exemplary embodiment. In addition to the linear portion 170, the first concave portion 174 and the second concave portion 176, the profile further includes a fourth portion shown as a convex portion 178. According to an another exemplary embodiment, a linear portion may replace all or a portion of the curve. Alternatively, multiple linear portions may be included in a profile of a non-planar surface.

Figure 7J:
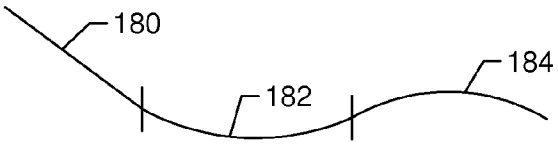

FIG. 7*j* illustrates a linear portion 180 provided at the front of the running surface which transitions into a concave curve 182 which then transitions into a convex curve 184.

According to an exemplary embodiment, the non-planar running surface of the manual treadmill 10 may include (or be so defined as to include) more or less than three portions. For example, FIG. 7*g* could be interpreted as defined two portions, the first portion including the front portion and the central portion, which comprise a convex curve having the same curvature throughout the front portion 150 and the central portion 152, and the second portion including the rear portion 154 which generally comprises a concave curve. According to some exemplary embodiments, some non-planar running surfaces include at least three or more portions.

According to an exemplary embodiment, the profile defined by the non-planar running surface is substantially a portion of a curve defined by any suitable second-order polynomial, but, as clearly demonstrated in FIGS. 7*a*-*j*, the profile defined by the non-planar running surface can be a portion of a curve that is a third-order polynomial or a fourth-order polynomial. According to yet another exemplary embodiment, the running surface profile can be substantially defined by a first-order polynomial, in other words, the running surface is substantially planar. An exemplary embodiment of a manual treadmill including a planar running surface will be discussed in more detail below (see e.g., FIG. 35).

According to an exemplary embodiment, the relative length of each portion of the running surface may vary. In the exemplary embodiment shown, the central portion is the longest. In other exemplary embodiments, the rear portion may be the longest, the front portion may be shorter than the intermediate portion, or the front portion may be longer than the rear portion, etc. It should be noted that the relative length may be evaluated based on the distance the portion extends along the longitudinal axis or as measured along the surface of the running belt itself. One of the benefits of integrating one or more of the various curves or contours into the running surface is that the contour of the running surface can be used to enhance or encourage a particular running style. For example, a curve integrated into the front portion of the running surface can encourage the runner to run on the balls of her feet rather than a having the heel strike the running belt 16 first. Similarly, the contour of the running surface can be configured to improve a user's running biomechanics and to address common running induced injuries (e.g., plantar fasciitis, shin splints, knee pain, etc.). For example, integrating a curved contour on the front portion of the running surface can help to stretch the tendons and ligaments of the foot and avoid the onset of plantar fasciitis.

One of the difficulties associated with using a running surface that has a non-planar shape is inducing the running belt 16 to assume the non-planar shape and then maintaining the running belt 16 in that non-planar shape when the treadmill is being operated. In addition to discussing this difficultly in more detail below, a number of running belt retention systems providing ways to induce and maintain a belt in a desired non-planar shape to define the running surface are discussed below. Generally, these running belt retention systems are adapted to control the relative contour of the running belt so that the running belt substantially follows the contour of the running surface One embodiment of a running belt retention system used to induce the running belt 16 to take-on the non-planar shape and then maintaining that shape, as shown in FIG. 5, is discussed in reference to FIGS. 5-6 and 8-11 in which base 12 is shown further including a pair of opposed bearing rails 200 to support the running belt 16 along with a front synchronizing belt pulley 202, a rear synchronizing belt pulley 204, and a synchronizing belt 206 all of which are interconnected to the running belt 16. The front rear synchronizing belt pulleys 202, 204 may be formed of the same or different materials as the front and rear running belt pulleys 62, 66.

Figure 6:
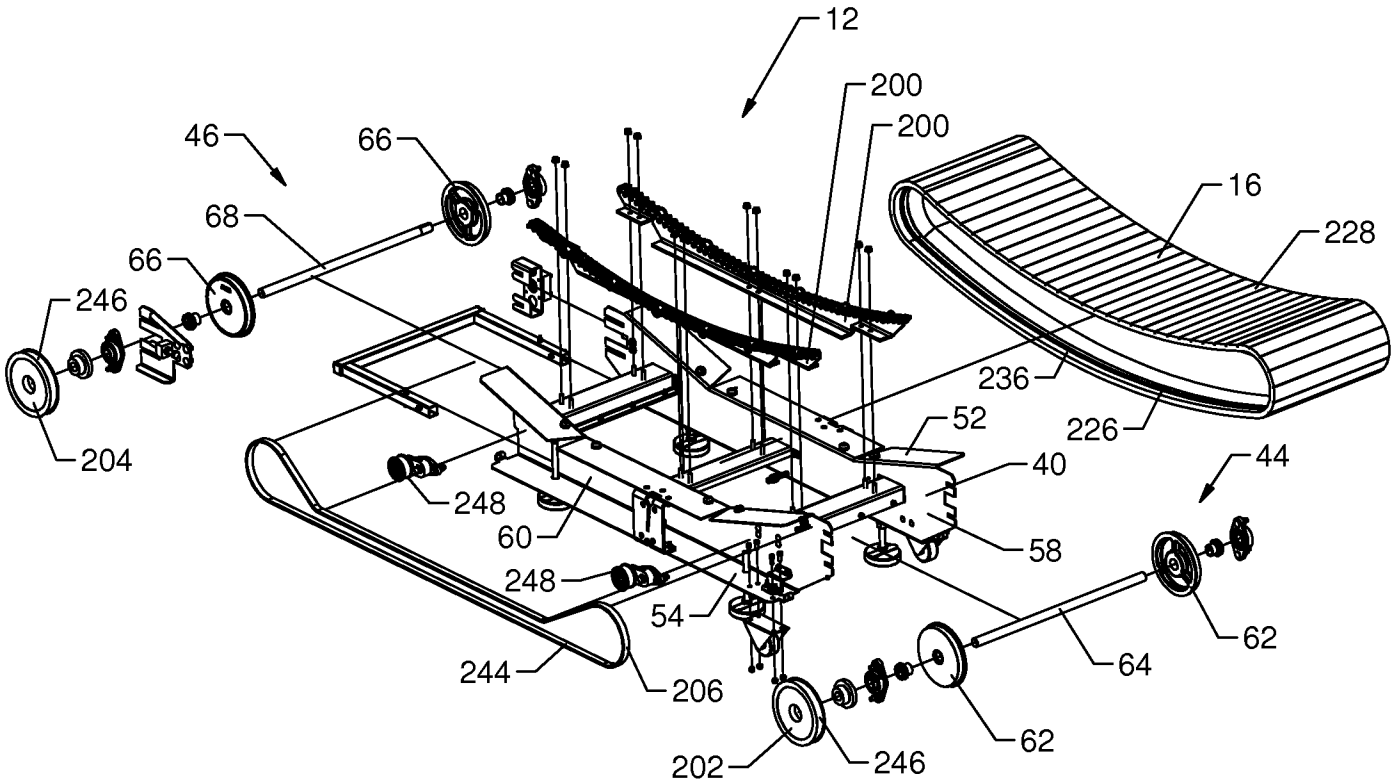
FIG. 6 is an exploded view of a portion of the manual treadmill of FIG. 1 having the side panels and handrail removed.
Figure 8:
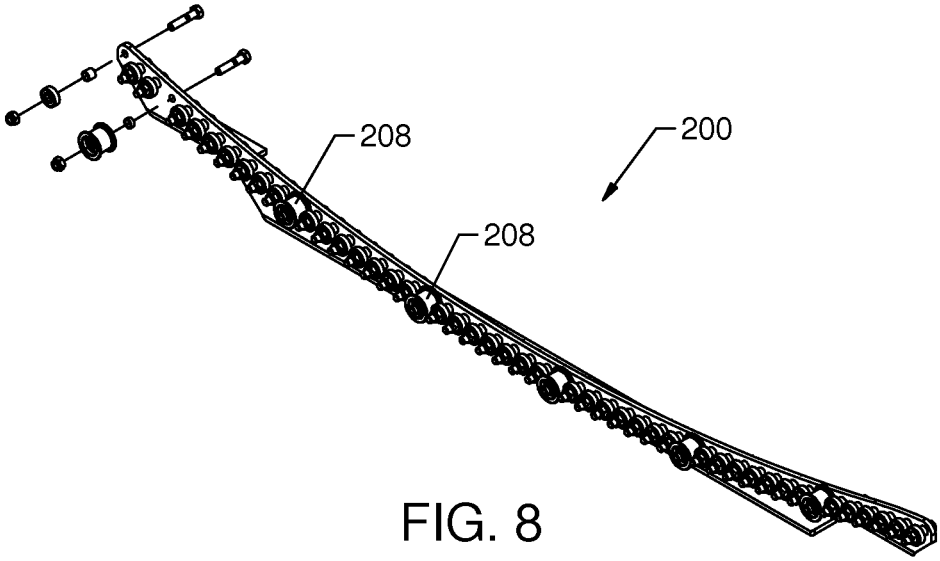
FIG. 8 is a partially exploded, perspective view of a bearing rail for the manual treadmill according to the exemplary embodiment shown in FIG. 1.
Figure 9:
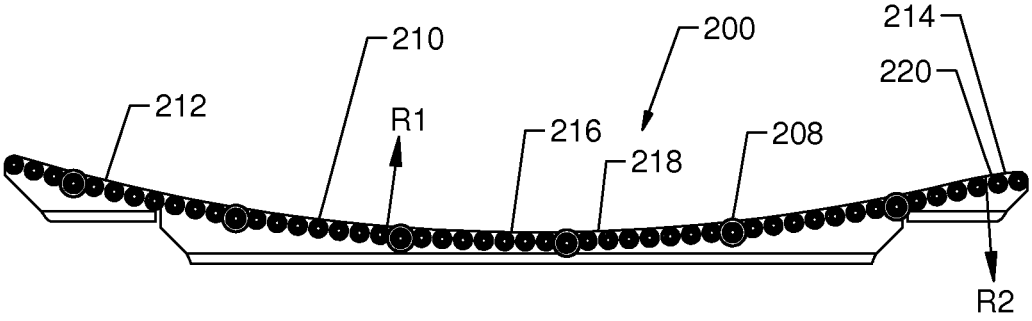
FIG. 9 is a side elevation view of the bearing rail of FIG. 6.

Referring to FIGS. 6 and 8-9, in particular, the bearing rails 200 are shown including a plurality of bearings 208 and an upper or top profile 210, shown shaped as a complex curve, according to an exemplary embodiment. The bearing rails 200 shown are supported by and preferably mounted to the frame 40 substantially between the front shaft assembly 44 and the rear shaft assembly 46, the support members or elements about which the running belt 16 is disposed. One bearing rail 200 is coupled to one or more of the cross-members 56 proximate to the inner surface 58 of the left-hand side member 52 and the other bearing rail 200 is coupled to one of more of the cross-members 56 proximate to the inner surface 58 of the right-hand side member 54 thereby fixing the position of the bearing rails 200 relative to the frame 40.

The bearing rails 200 are preferably configured to facilitate movement of the running belt 16. In the exemplary embodiment seen in FIGS. 8-9, the running belt 16 moves substantially along the top profile 210 of the bearing rails 200. The running belt 16 contacts and is supported in part by the bearings 208 of the bearing rails and bearing 208 are configured to rotate, thereby decreasing the friction experienced by the running belt 16 as the belt moves along the top profile 210. The bearing rails 200 are configured to help achieve the desired shape of the running surface. The shape of the top profile 210 of the bearing rails 200 at least partially corresponds to the desired shape for the running surface 70. The at least somewhat flexible running belt 16 substantially assumes the shape of top profile 210 of the bearing rails 200 by being maintained substantially thereagainst, as will be discussed in more detail later. Accordingly, the running surface 70 has a shape that substantially corresponds to the shape of the top profile 210 of the bearing rails 200. It should be noted that the front and/or rear running belt pulleys may also help define a portion of the shape of the running surface. Also, other suitable shape-providing components may be used in combination with the bearing rails.

FIG. 9 provides a side view of one of the bearing rails 200 to more clearly show the top profile 210 according to an exemplary embodiment. Similar to the running surface 70, discussed above, the top profile 210 of the bearing rails 200 can be generally divided up into three general regions, the front portion 212 which is adjacent to the front shaft assembly 44 (see e.g., FIG. 5), the rear portion 214 which is adjacent to the rear shaft assembly 46 (see e.g., FIG. 5), and the central portion 216, intermediate the front portion 212 and the rear portions 214. The central portion 216 is shown as a concave curve 218 that has a radius of curvature R1. The front portion 212 is further shown as a continuation of the concave curve 218 of the central portion 216, and, thus, also has a radius of curvature of R1. The rear portion 214 is shown as a convex curve 220 that has a radius of curvature R2. The front portion 212 is shown disposed substantially tangential to the central portion 216, providing a smooth transition therebetween, and helping provide a smooth shape for the running surface 70. The shape of the rear portion 214 also helps provide a smooth transition for the running belt 16 from the bearing rails 200 onto the rear running belt pulleys 66, which helps ensure as much contact as possible between the running belt 16 and the rear running belt pulleys 66. As the shape of the running surface substantially corresponds to the shape of top profile the bearing rails, the shape of the top profile of the bearing rails can necessarily be any of the shapes and/or have any of the variations (e.g., in length of portions, etc.) discussed above in FIGS. 7*a* through 7*j* with reference to possible shapes of the running surface.

According to an exemplary embodiment, each portion of the top profile is disposed substantially tangential to the portions adjacent thereto. According to other exemplary embodiments, less than all of the adjacent portions are disposed substantially tangential to the portions adjacent thereto, meaning the profile does not have an entirely smooth contour.

According to an exemplary embodiment shown in FIG. 9, R1 is approximately 7.26 feet. However, it is understood that a radius anywhere from 5 feet to 100-plus feet can be used. The size of the radius which can be used is typically a function of the length of the treadmill which can be accommodated. The range of possible radiuses for a convex bearing rail depends on the shaft-to-shaft distance of the treadmill (see e.g., measurement "x" in FIG. 5, discussed in more detail below). Assuming that the radius of curvature of the curve is $R_C$, the radius of the front running belt pulley is $R_f$, and the radius of the rear running belt pulley is $R_r$, the range of possible radiuses is approximately: $\infty > R_C > (x - R_f - R_r)/2$. For most commercial-available treadmills, x is approximately between 14 inches and 10 feet but the treadmill can certainly be as great as 25 feet in length. According to the exemplary embodiment shown in FIG. 5, x is approximately 57.8 inches in length. According to another exemplary embodiment, x is approximately 77.2 inches in length, with a radius R1 of approximately 8.67 feet, wherein the greater length x and radius R1 may facilitate use of the treadmill 10 by users with a longer running gait. The limiting factors in the length are the available space to accommodate the treadmill and the relative cost of constructing such a large treadmill.

When the treadmill 10 is being operated, the running belt 16 is driven rearwardly and the goal is to ensure that the running belt 16 follows the profile defined by a portion of the circumference of the front running pulleys 62, the contoured profile defined by the bearings 208 supported on the bearing rails 200 and finally by a portion of the circumference of the rear running belt pulleys 66. The particular contour which the running belt 16 assumes on the bottom of the base 12 between the rear running belt pulleys 66 and front running belt pulleys 62 is not terribly critical provided that the running belt continues to move with minimal friction and is not subject to excessive wear or obstruction.

Following the shape of the bearing rails 200 is not the natural tendency of the running belt for the particular contour seen in FIG. 5. Rather, without more, the running belt 16 tends to be pulled upward, away from the curved bearing rails and across the central portion 76 of the treadmill 10. Under the force of gravity, the weight of the running belt 16 coupled with the relative spacing between the front and rear running belt pulleys 62 and 66, respectively, would likely result in the top surface of the running belt 16 assuming a position of the shortest distance between the two pulleys, namely, a substantially straight line between the two pulleys with any excess length of the running belt 16 collecting on the bottom of the treadmill and hanging below the front and rear running belt pulleys 62 and 66, respectively. Therefore, a system of some sort needs to be integrated into a non-planar running surface treadmill to ensure that the running belt 16 follows the desired contour over the running surface.

Further referring to FIGS. 5-6 and 8-11, one way to ensure that the running belt 16 follows the contour of the bearing rails 200 and the front and rear running belt pulleys 62, 66 is to utilize the weight of the running belt 16 itself in addition to adjusting the relative size of the front and rear running belt pulleys 62, 66; and/or providing a synchronizing system 222 according to an exemplary embodiment.

As discussed above, the running belt 16 is disposed about the front and rear running belt pulleys 62, 66 which in turn are disposed about front and rear shafts 64, 68, respectively. Measured along the longitudinal axis 18 between the centerlines of the front and rear shafts 64, 68, the front and rear shafts 64, 68 are spaced a distance x from each other, as shown in FIG. 5. Accordingly, when positioning the running belt 16 about the front and rear running belt pulleys 62, 66, the length of the running belt 16 provided therebetween must be at least x (e.g., the straight-line distance therebetween). It follows that, when the profile of the running surface 70 is non-planar, the length of the running belt provided between the front and rear shafts 64, 68 will be greater than x.

In the exemplary embodiment shown in FIG. 5, when positioning the running belt 16 about the front and rear running belt pulleys 62, 66, a length of the running belt 16 sufficient to permit the running belt 16 to correspond to (e.g., follow, be positioned against or above, etc.) the desired contours of the bearing rails 200 and the front and rear running belt pulleys 62, 66 is generally disposed between the front and rear shafts 64, 68. At each location between the front and rear shafts 64, 68, the force of gravity pulls downward on the running belt 16. Generally, this force will help pull the running belt 16 downward and against the desired components of base 12. However, gravity can also cause slippage (e.g., over the front running belt pulley 62, over the rear running belt pulley 66, down along curves of the bearing rail 200, etc.) in an amount that is undesirable and the magnitude of these slippage-problems tends to increase when the treadmill 10 is being operated. Accordingly, the solution typically relies on more than the weight of the running belt alone.

Further referring to FIGS. 5-6 and 8-11, the preferred embodiment of the running belt 16 is shown including two reinforcing belts shown as endless belts 226 and a plurality of slats 228 according to an exemplary embodiment. The endless belts 226 are configured to provide support for the running belt 16 in order to support the weight of a user. The endless belts 226 are shown disposed on opposite sides of the running belt 16, generally interior to the outer, lateral edge of the slats 228. The endless belts 226 are themselves reinforced, and thus help stabilize the sides of the running belt and help prevent stretching of the running belt 16. For example, the endless belts may be reinforced with metal wiring, which is surrounded by a molded plastic coating. According to some exemplary embodiments, more or less than two endless belts may be used. According to other exemplary embodiments, other suitable support elements may be used to provide support for the running belt. Further details regarding the structure of the running belt and endless belt structure are seen in U.S. Pat. No. 5,470,293, titled "Toothed-Belt, V-Belt, and Pulley Assembly, for Treadmills," which is incorporated by reference herein.

The endless belts 226 are further configured to interact with the front running belt pulleys 62 and the rear running belt pulleys 66. The location of each endless belt 226 laterally, along the width of the running belt 16, substantially corresponds to the location of a longitudinally aligned front running belt pulley 62 and rear running belt pulley 66. Each endless belt 226 includes a first or inner portion 230 and a second or outer portion 232 at an interior surface 236 according to an exemplary embodiment. The inner portion 230 is in contact with an exterior surface 234 of the corresponding running belt pulleys 62, 66. According to some exemplary embodiments, the outer portion 232 is also in contact with the exterior surface 234 of the corresponding running belt pulleys 62, 66.

Figure 12:
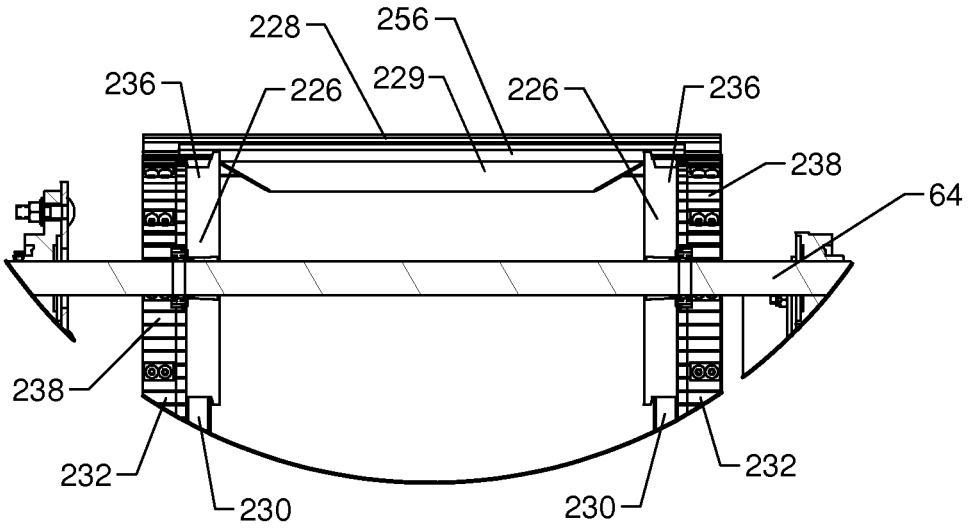
FIG. 12 is a partial, cross-sectional view of the manual treadmill taken along line 12-12 of FIG. 1.

FIG. 12 illustrates a running belt and running belt pulley combination wherein the exterior surfaces 234 of the front running belt pulleys 62 are substantially smooth and are in contact with the interior surface 236 of the endless belts 226, which is also substantially smooth according to an exemplary embodiment. The outer portion 232 is shown substantially not in contact with the exterior surfaces 234 of the front running belt pulleys 62. The outer portion 232 is further shown including a plurality of teeth 238 (e.g., being toothed); however, according to other exemplary embodiments, the outer portion may be smooth or have any suitable texture and/or configuration. In this embodiment, both of the running belt pulleys come in contact with the inner, substantially smooth portion of the endless belts, and a toothed portion of the endless belts is disposed to the outside of the running belt pulleys on both sides.

Figure 13:
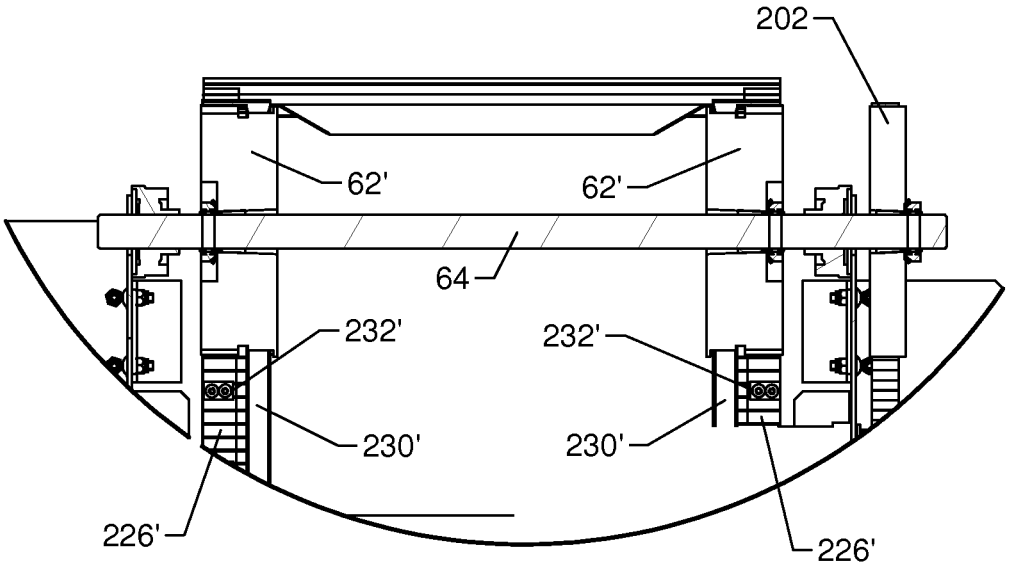
FIG. 13 is an alternative exemplary embodiment of the partial, cross-sectional view of the manual treadmill similar to FIG. 12.

FIG. 13 illustrates an alternative running belt and running belt pulley combination according to an exemplary embodiment. In this exemplary embodiment, the front running belt pulleys 62' include a first or inner portion 230' and a second or outer portion 232'. The inner portion 230' of the front running belt pulleys 62' is substantially smooth, while the outer portion 232' includes a plurality of teeth, to correspond to the inner and outer portions 230', 232', of the endless belts 226', respectively. In this embodiment, both of the running belt pulleys include an inner, smooth portion and an outer, toothed portion. These portions correspond to an inner, smooth portion of the endless belt and an outer, toothed portion of the endless belt. This endless belt/front running belt pulley configuration is discussed in more detail in U.S. Pat. No. 5,470, 293, titled "Toothed-Belt, V-Belt, and Pulley Assembly, for Treadmills," which is herein incorporated by reference in its entirety.

According to still another an exemplary embodiment, a combination of the endless belt/front running belt pulley configurations shown in FIGS. 12 and 13 is used. In this exemplary embodiment, the smooth belt and pulley configuration shown in FIG. 12 is used for the front running belt pulleys and the combination of smooth and toothed belt and pulley configuration shown in FIG. 13 is used for the rear running belt pulleys. In another exemplary embodiment, the configuration shown in FIG. 13 is used for the front running belt pulleys and the configuration shown in FIG. 12 is used for the rear running belt pulleys.

The slats 228 of the running belt 16 are configured to help support a user of the treadmill 10. The slats 228 may be made of substantially any suitably sturdy material (e.g., wood, plastic, metal, etc.) and extend generally laterally between the endless belts 226. Each slat 228 is coupled at its ends 252, 254 to the second portions 232 of the endless belts 226 using fasteners. According to other exemplary embodiments, the slats may be otherwise coupled to the endless belts (e.g., adhered, welded, etc.) in the manner disclosed in U.S. Pat. No. 5,470,293, titled "Toothed-Belt, V-Belt, and Pulley Assembly, for Treadmills," which is incorporated herein by reference. Each slat is shown to include a portion 229 (e.g., stem, web, etc.) extending inwardly from an interior surface 256 of the slat 228.

According to an exemplary embodiment, the running belt may be substantially any suitable, continuous loop element, including, but not limited to, a continuous urethane (e.g., polyurethane) loop, a continuous loop made of plastics other than polyurethane, a plastic belt reinforced with reinforcing elements (e.g., metal wire, a relatively harder plastic, wood, etc.), a continuous foam loop, a loop formed by a plurality of interconnected members (e.g., metallic members, wooden members, etc.) in a manner to provide at least some flexibility, etc.

Figure 10:
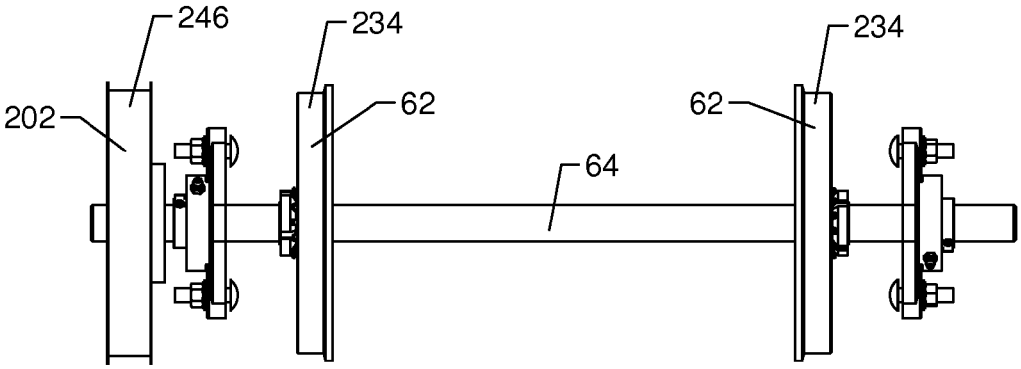
FIG. 10 is a top elevation view of a front shaft assembly for the manual treadmill according to the exemplary embodiment shown in FIG. 1.
Figure 11:
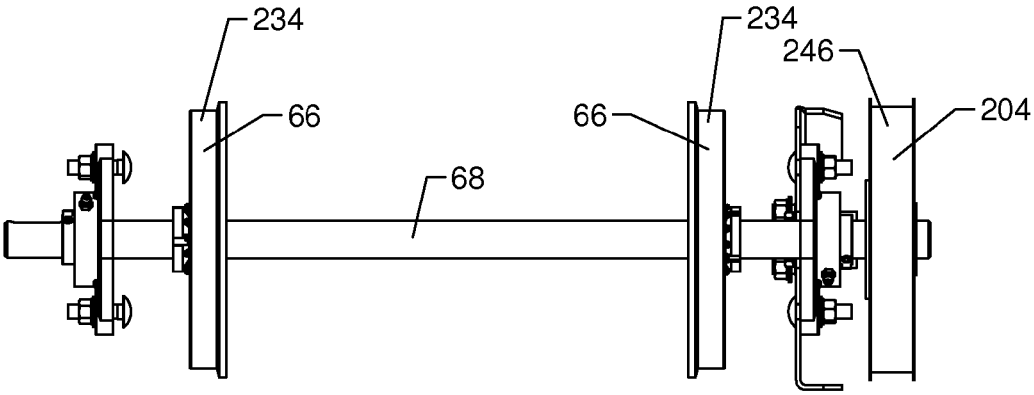
FIG. 11 is a top elevation view of a rear shaft assembly for the manual treadmill according to the exemplary embodiment shown in FIG. 1.

Referring to FIGS. 6, 10 and 11, another aspect of the solution to ensuring the running belt 16 follows the desired contour involves the utilizing front running belt pulleys 62 that are slightly larger than the rear running belt pulleys 66. That is, the radius of the front running belt pulleys, $R_f$, is greater than the radius of the rear running belt pulleys, $R_r$. Assuming the front running belt pulleys 62 are rotating with the same rotational velocity (e.g., angular speed) as the rear running belt pulleys 66, the tangential velocity of the front running belt pulleys 62 is slightly greater than the tangential velocity of the rear running belt pulleys 66. Thus, as the running belt 16 is driven, the portion of the running belt 16 disposed proximate the front end 20 of the treadmill 10 will be moved over the front running belt pulleys 62 and rearward with slightly greater speed than the rear running belt pulleys 66 move the portion of the running belt 16 proximate thereto. Thus, the front running belt pulleys 62 essentially "push" the running belt 16 rearward, creating a slight amount of excess running belt 16 in the area between the front running belt pulleys 62 and the rear running belt pulleys 66, which helps to counter the force of gravity which would attempt to gather any excess length of running belt 16 on the bottom of the treadmill 10 thereby causing the top surface of the running belt 16 to assume a position of the shortest distance between the two pulleys, namely, a substantially straight line between the two pulleys. Obviously the system cannot tolerate too much excess length of running belt feeding off the front running belt pulley 62 so periodically, a portion of this excess running belt 16 will slip over the rear running belt pulley 66. By specifically balancing the excess running belt 16 coming off the front running belt pulley 62 against the slippage allowed on the rear running belt pulley 66, the running belt 16 will follow the desired concave, convex or linear (or combinations thereof) contours of the running surface.

If the difference between the radius of the front running belt pulleys 62 and the radius of the rear running belt pulleys 66 is too large, the running belt 16 will begin to bunch up atop the base 12 as too much excess is generated. Accordingly, there is a practical limit of differences between the radius of each of the front running belt pulleys 62 and the radius of each of the rear running belt pulleys 66. Generally, this range may be dependent on the length of the running surface, as measured along the running belt, and/or the shape of the running surface. According to an exemplary embodiment, the size difference between the radii of the front and rear running belt pulleys, $R_f-R_r$, is within the range of approximately $0<R_f-R_r<0.100$ inches. Preferably, the size difference between the radii of the front and rear running belt pulleys, $R_f-R_r$, is within the range of approximately $0.005<R_f-R_r<0.035$ inches. In one embodiment, the radius of the front running belt pulleys is approximately 7.00"+/−0.010" and the radius of the rear running belt pulleys is approximately 6.985"+/−0.010. According to another exemplary embodiment, instead of using front and rear running belt pulleys having a radial size difference, the synchronizing belt pulleys may have a radial size difference. Similar to the differently sized front and rear running belt pulleys, the differently sized front and rear synchronizing pulleys would be used to essentially "push" the running belt rearward, creating a slight amount of excess running belt 16 in the area between the front running belt pulleys and the rear running belt pulleys.

Another means for ensuring that the running belt 16 follows the desired complex curve is to match the rotational velocity of the front running belt pulleys 62 to that of the rear running belt pulleys 66 utilizing a synchronizing system 222. Further referring to FIGS. 5-6 and 8-11, the synchronizing system 222 is shown generally to comprise the front synchronizing belt pulley 202, the rear synchronizing belt pulley 204, and the synchronizing belt 206 according to an exemplary embodiment.

The front synchronizing belt pulley 202 is rotatably mounted relative to the front shaft 64, similar to the front running belt pulleys 62. Preferably, the front synchronizing belt pulley 202 is securely mounted directly to the front shaft 64. Similarly, the rear synchronizing belt pulley 204 is fixed relative to the rear shaft 68 and preferably securely mounted to the rear shaft 68. Accordingly, the front synchronizing belt pulley 202 will move with substantially the same rotational speed as the front running belt pulleys 62, and the rear synchronizing belt pulley 204 will move with the same rotational speed as the rear running belt pulleys 66. When the front shaft assembly 44 and the rear shaft assembly 46 are coupled to the frame 40, the front and rear synchronizing belt pulleys 202, 204 are shown disposed exterior to the outer surface 60 of the left-hand side member 52. According to another exemplary embodiment, the front and rear synchronizing belt pulleys may be placed exterior to the outer surface of the right-hand side member of the frame. According to other exemplary embodiments, the synchronizing system may be disposed substantially between the left-hand side member and the right-hand side member of the frame.

The synchronizing belt 206 is configured to provide a force that helps ensure that the front and rear shafts 64, 68 are rotating (e.g., moving, spinning, etc.) at the same rotational velocity. The synchronizing belt 206 is shown as an endless belt that is adapted to be supported in tension about the front synchronizing belt pulley 202 and the rear synchronizing belt pulley 204, as shown in FIGS. 4-5. As the running belt pulleys 62, 66 and the synchronizing belt pulleys 202, 204 are both substantially fixed relative to the front shaft 64 and the rear shaft 68, the rotation of the front shaft 64 and the rear shaft 68 causes the front synchronizing belt pulley 202 and the rear synchronizing belt pulley 204 to similarly rotate. In response to the motion of the front synchronizing belt pulley 202 and the rear synchronizing belt pulley 204, the synchronizing belt 206, which connects the front shaft assembly 44 and the rear shaft assembly 46, similarly rotates. Because of the tension in the synchronizing belt 206 and the fact that the synchronizing belt pulleys 202, 204 are the same size, the synchronizing belt 206 provides a counter force in response to any deviation in rotational velocity between the front shaft assembly 44 and the rear shaft assembly 46. For example, if the rear shaft assembly 46 was induced to start moving with greater rotational velocity than the front shaft assembly 44, the tension in the upper portion of the synchronizing belt (i.e., that portion of the synchronizing belt that extends generally between the tops of the synchronizing pulleys) would resist any differential rotation between the front and rear synchronizing belt pulleys 202, 204. Continuing with the example, any discrepancy between the rotational velocity of the front and rear shafts 64, 68 is similarly resisted by the engagement of the synchronizing belt 206. Thus, by constraining the relative motion of the front shaft assembly 44 and the rear shaft assembly 46, the synchronizing system 222 keeps their rotational velocity in sync, substantially preventing the front and rear running belt pulleys 62, 66 from becoming unsynchronized and moving at different rotational velocities.

So, in practice, the running belt 16 is initially installed on the front and rear running belt pulleys 62, 66 and the running belt 16 is manually positioned in the desired position so that a sufficient length of the running belt 16 is positioned along the top of the treadmill and the running belt 16 assumes the desired contour. While the running belt 16 is maintained in this position, the synchronizing belt 206 is mounted to the synchronizing belt pulleys 202, 204 and once the synchronizing belt 206 is installed, it effectively resists differential rotation of the running belt pulleys 62, 66 which could result in loss of the desired contour of the running belt 16.

It should be noted that the tension in the synchronizing belt 206 also helps maintain the position of the synchronizing belt 206 relative to the synchronizing belt pulleys 202, 204. The tension helps enhance friction between an interior surface 244 of the synchronizing belt 206 and exterior surfaces 246 of the synchronizing belt pulleys 202, 204, making it less likely that the synchronizing belt 206 will slip relative to the synchronizing belt pulleys 202, 204.

Figure 3:
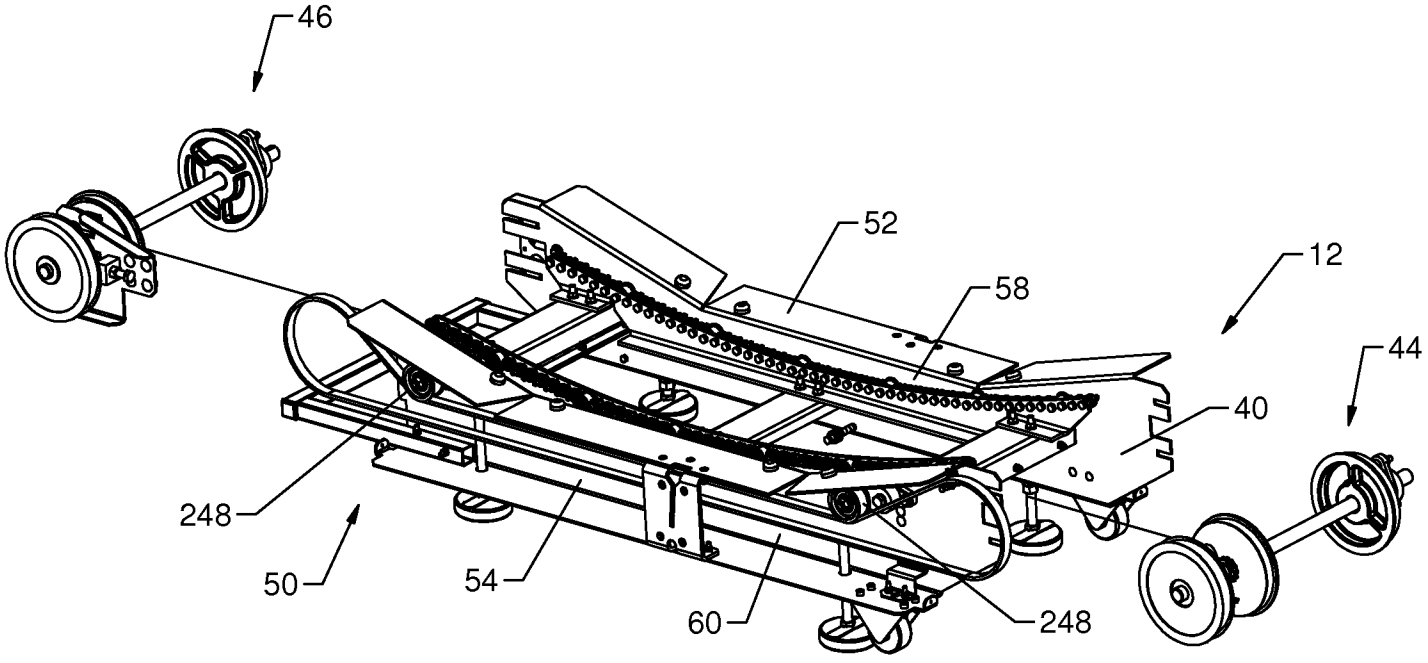
FIG. 3 is a right-hand partially exploded perspective view of a portion of the manual treadmill according to the exemplary embodiment shown in FIG. 1.

One or more tensioning assemblies 248 may be provided to adjust the tension in the synchronizing belt 206 (see e.g., FIGS. 3 and 6 illustrating tensioning assemblies 248). Tensioning assemblies 248 are configured to move portions of the synchronizing belt 206 relative to one another, stretching the synchronizing belt 206 and maintaining this stretch so that the synchronizing belt 206 can provide the necessary resistance to differential rotation of the front and rear running belt pulleys 62, 66. Alternatively, the tensioning assemblies 248 can be adjusted to release some of the tension in the synchronizing belt 206. Releasing some of the tension may be desirable if the synchronizing belt 206 is too tight, causing excess friction between the synchronizing belt 206 that makes it too difficult to rotate the front and rear shaft assemblies 44, 46 (e.g., greater than desired by the user, too great to function, etc.). The tensioning assemblies 248 are also used when the synchronizing belt 206 is being installed and removed. According to another exemplary embodiment, a single tensioning assembly is used in conjunction with one or more stationary idlers. According to still another exemplary embodiments, any devices or elements suitable for maintaining and/or adjusting the tension in the synchronizing belt may be used.

Figure 14:
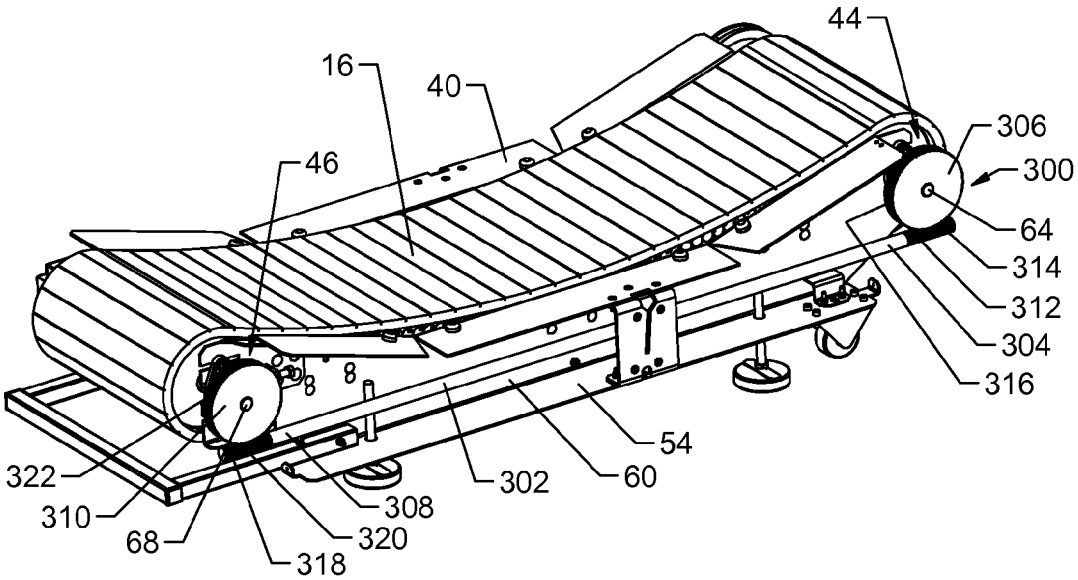
FIG. 14 is a perspective view of an alternative embodiment of a synchronizing system integrated into a manual treadmill.

Referring to FIG. 14, a synchronizing system 300 is shown according to another exemplary embodiment. The synchronizing system 300 would typically be used in lieu of the previously described synchronizing system 222. In this next exemplary embodiment, the synchronizing system 300 is shown comprising a synchronizing shaft 302 mechanically connected at a first end 304 to a front gear 306 and at a second end 308 to a rear gear 310. The front gear 306 is interconnected with, and preferably directly mounted and fixed relative to, the front shaft 64, and the rear gear 310 is interconnected with, and preferably directly mounted and fixed relative to, the rear shaft 68. Accordingly, the front gear 306 will move with substantially the same rotational speed as the front running belt pulleys 62, and the rear gear 310 will move with the same rotational speed as the rear running belt pulleys 66. When the front shaft assembly 44 and the rear shaft assembly 46 are coupled to the frame 40, the front and rear gears 306, 310 are shown disposed exterior to the outer surface 60 of the right-hand side member 54. According to another exemplary embodiment, the front and rear gears 306, 310 may be placed exterior to the outer surface of the left-hand side member of the frame. According to other exemplary embodiments, the synchronizing system may be disposed substantially between the left-hand side member and the right-hand side member of the frame.

The synchronizing shaft 302 is configured to provide a force that helps ensure that the front and rear shafts 64, 68 are rotating (e.g., moving, spinning, etc.) at the same rotational velocity. The synchronizing shaft 302 is shown as an elongated, substantially cylindrical member that extends generally between the front shaft 64 and the rear shaft 68. A first threaded portion 312 including a plurality of threads 314 is shown located at the first end 304 of the synchronizing shaft 302 and is configured to mesh with a plurality of teeth 316 of the front gear 306 that is fixed relative to the front shaft 64. A second threaded portion 318 including a plurality of threads 320 is shown located at the second end 308 of the synchronizing shaft 302 and is configured to mesh with a plurality of teeth 322 of the rear gear 310 that is fixed relative to the rear shaft 68.

The synchronizing shaft 302 rotates in response to the motion of the front gear 306 and the rear gear 310. When the front shaft 64 and the rear shaft 68 rotate in response to the user driving the running belt 16, the front gear 306 and the rear gear 310, which are fixed relative to the front shaft 64 and the rear shaft 68, respectively, similarly rotate. The front gear 306 meshes with and imparts rotational motion to the first threaded portion 312, and, thereby, imparts rotational motion to the synchronizing shaft 302. The rear gear 310 meshes with and imparts rotational motion to the second threaded portion 318, and, thereby, imparts rotational motion to the synchronizing shaft 302.

Because the synchronizing shaft 302 is rigid and the front and rear gears 306, 310 are the same size, the synchronizing shaft 302 provides a counter force in response to any deviation in rotational velocity between the front shaft assembly 44 and the rear shaft assembly 46. For example, if the rear shaft assembly 46 was induced to start moving with greater rotational velocity than the front shaft assembly 44, the rear gear 310 would be prevented from moving with greater rotational velocity than the front gear 306 because of the synchronizing shaft 302. The second threaded portion 318 is meshed with the rear gear 310. The second threaded portion 318 is fixed relative to the first threaded portion 312. The first threaded portion 312 is meshed with the front gear 306, which is moving with less rotational velocity than the rear gear 310. The front gear 306, being fixed relative to the front shaft assembly 44 which is also traveling at the same rotational velocity, seeks to continue at this rotational velocity. Thus, the force transmitted to the front gear 306 from the rear gear 310 by the synchronizing shaft 302 is met with a counter force. Specifically, the teeth 322 of the front gear 306 counter the force applied thereto by the threads 314 of the first threaded portion 312 at the first end 304. This counter force substantially prevents the rotational velocity of the synchronizing shaft 302, which includes the second threaded portion 318, from increasing. Stated otherwise, the force applied is sufficient to prevent the second end 308 of the synchronizing shaft 302 from rotationally advancing ahead of the first end 304. As the second threaded portion 318 is prevented from experiencing an increase in rotational velocity, the second threaded portion 318 provides a counter force to the rear gear 310. Specifically, the threads 320 of the second threaded portion 318 counter the force applied thereto by the teeth 322 of the rear gear 310. Thus, the synchronizing shaft 302 constrains the relative motion of the front gear 306 and rear gear 310, and, thereby constrains the relative motion of the front shaft assembly 44 and the rear shaft assembly 46.

Figure 15:
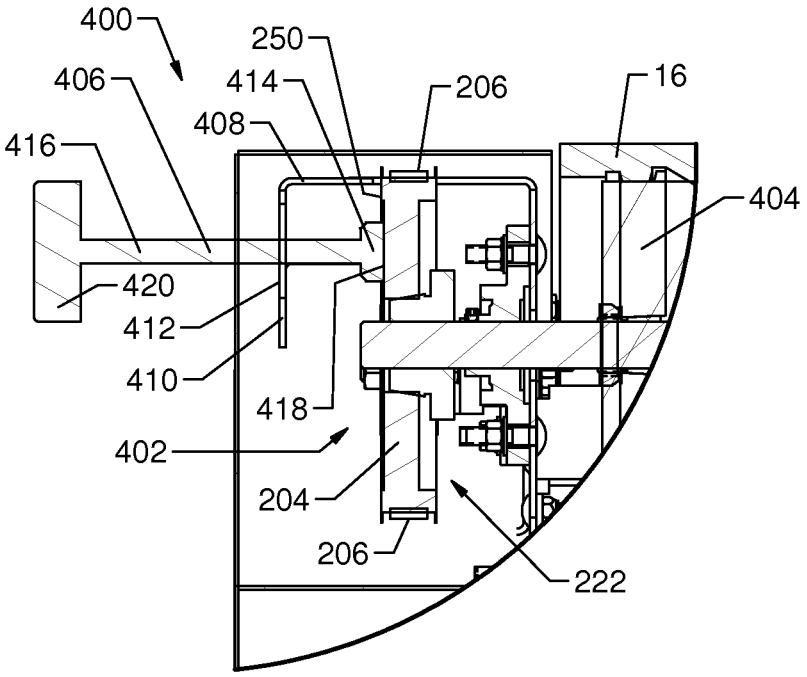
FIG. 15 is a partial, cross-sectional view of a manual treadmill including an exemplary embodiment of a braking system taken along line 15-15 of FIG. 4.

Another embodiment of a running belt retention system used to induce and maintain the running belt in a desired non-planar shape to define the running surface is seen in FIG. 15, specifically a braking system 400 configured to help induce and maintain the running belt in a desired non-planar shape to define the running surface is shown according to an exemplary embodiment. Please note, the section lines 15-15 shown in FIG. 4 do not necessarily suggest that the braking system 400 seen in FIG. 15 is integrated into the manual treadmill depicted in FIG. 4, rather, the section line 15-15 is included in FIG. 4 to show one potential location for the integration of a braking system into a manual treadmill according to the various innovations disclosed herein. The braking system 400 is shown in cooperation with the rear shaft assembly 402 and the synchronizing system 222. The rear shaft assembly 402 differs from the above-discussed rear shaft assembly 46 in that the rear shaft assembly 402 includes a pair of rear running belt pulleys 404 that are substantially the same size as the front running belt pulleys (not shown).

The braking system 400 has substantially the same effect as the differently sized front and rear running belt pulleys discussed above. That is, the braking system 400 causes a slight amount of excess running belt 16 in the area between the front running belt pulleys and the rear running belt pulleys. More specifically, the braking system 400 causes the rotational velocity of the rear shaft assembly 402 to be slightly lower than the rotational velocity of the front shaft assembly by applying a frictional force to the rear synchronizing belt pulley 204. Thus, the braking system 400 acts on the synchronizing system 222 to force (e.g., urge, push, move, etc.) the rear shaft assembly 402 out of synch with the front shaft assembly.

The braking system 400 includes a generally elongated member 406 in cooperation with the synchronizing system 222. The elongated member 406 is coupled to the rear shaft assembly 402 by a bracket 408 having a first side 410 spaced a distance apart from an outer surface 250 of the rear synchronizing belt pulley 204. The elongated member 406 is disposed through an aperture 412 of the bracket 408 and includes a first end 414 disposed to the inside of the first side 410 and a second end 416 disposed to the outside of the first side 410. The first end 414 includes a surface 418 configured to contact the outer surface 250 of the rear synchronizing belt pulley 204. The second end 416 includes a knob 420 configured to be gripped by a person (e.g., a user, a trainer, etc.) and to have a rotational force imparted thereto. An exterior surface of the elongated member 406 is at least partially threaded to correspond to threading at an interior surface defining the aperture 412. Rotating the knob 420, and, thereby, the elongated member 406, in one direction, causes the surface 418 to be advanced toward the outer surface 250 of the rear synchronizing belt pulley 204, and rotating the knob 420 in the opposite direction causes the surface 418 to retreat or be moved away from the outer surface 250 of the rear synchronizing belt pulley 204.

During operation of the treadmill, the surface 418 of the elongated member 406 is substantially in contact with the outer surface 250 of the rear synchronizing belt pulley 204, creating friction therebetween. As the rear synchronizing belt pulley 204 of the synchronizing system 222 is fixed relative to the rear shaft assembly 402, some of the force directed to the rear shaft assembly 402 to impart rotation thereto must be used to overcome the frictional force between the surface 418 of the elongated member 406 and the outer surface of the rear synchronizing belt pulley 204. As the force needed to overcome the frictional force between the surface 418 of the elongated member 406 and the outer surface 250 of the rear synchronizing belt pulley 204 is no longer being directed into rotation of the rear shaft assembly 402, the rotational velocity of the rear shaft assembly 402 is less than the rotational velocity of the front shaft assembly. Thus, the front running belt pulleys of the front shaft assembly will "push" the running belt rearward, creating a slight amount of excess running belt 16 in the area between the front running belt pulleys and the rear running belt pulleys. This excess length of running belt 16 helps to counter the force of gravity, discussed in more detail above. It should be noted that, because the friction between the surface 418 of the elongated member 406 and the outer surface 250 of the rear synchronizing belt pulley 204 is substantially constant during operation, the rotational velocity will be substantially maintained at the lower rotational velocity.

The length of excess running belt "pushed" rearward by the front running belt pulleys can be varied by adjusting the position of the surface 418 relative to the outer surface 250 of the rear synchronizing belt pulley 204. If one moves the surface 418 laterally closer to the outer surface 250, the friction therebetween will increase, the differential between the rotational velocity of the rear shaft assembly and the front shaft assembly will increase, and the length of the excess will increase. If one moves the surface 418 away from the outer surface 250, the friction therebetween will decrease (or be removed if they are brought out of contact), the differential between the rotational velocity of the rear shaft assembly and the front shaft assembly will decrease, and the length of the excess will decrease.

According to another exemplary embodiment, the braking system 400 may be used with front and rear running belt pulleys that have a size differential. In such an embodiment, the braking system 400 would be used to fine tune the length of excess running belt pushed rearward with each rotation of the front and rear running belt pulleys.

Figure 16:
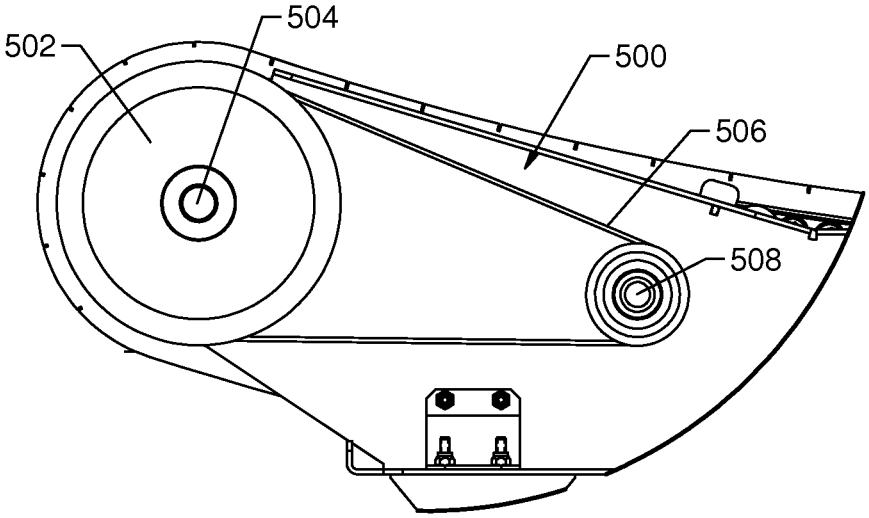
FIG. 16 is a partial, cross-sectional view of a manual treadmill including another exemplary embodiment of a braking system taken along line 16-16 of FIG. 4.
Figure 20:
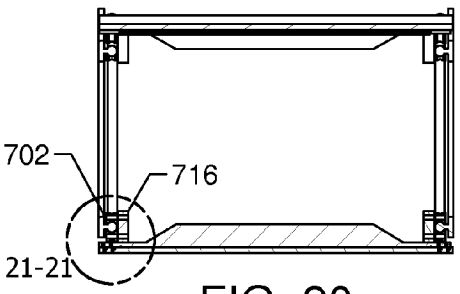
FIG. 20 is a partial cross-sectional view of the track system of FIG. 18 taken along line 20-20.
Figure 21:
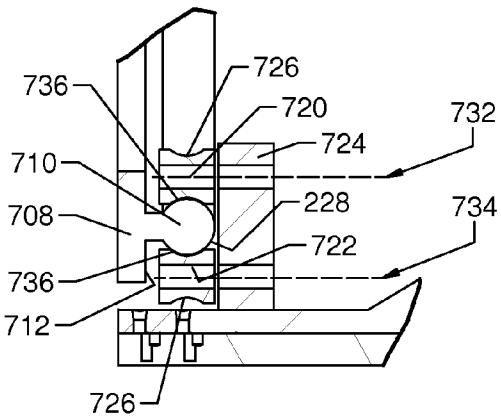
FIG. 21 is a detail view of the track system of FIG. 20 taken along line 21-21.
Figure 18:
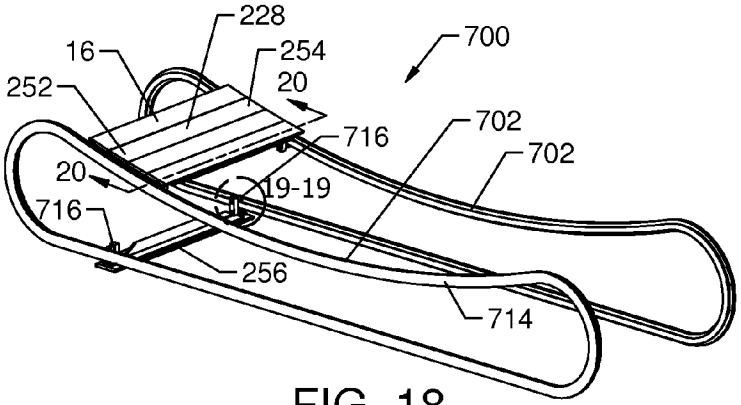
FIG. 18 is a side perspective view of a track system for use with the exemplary embodiment of a manual treadmill shown in FIG. 1 and configured to help induce and maintain a running belt in a desired non-planar shape to define a running surface.
Figure 19:
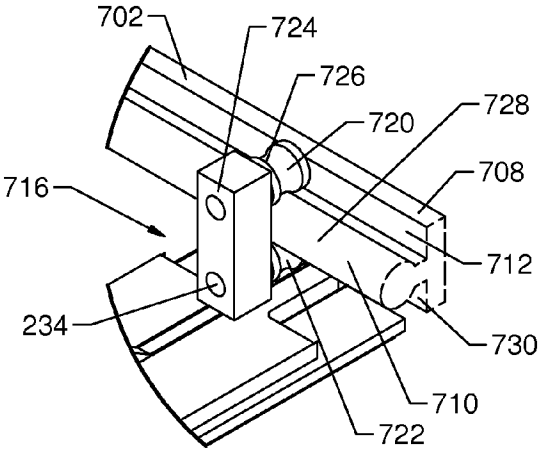
FIG. 19 is a detail view of the track system of FIG. 18 taken along line 19-19.

FIG. 16 illustrates another exemplary embodiment of a braking system, shown as braking system 500, configured to help induce and maintain the running belt in a desired non-planar shape to define the running surface. Please note, the section lines 16-16 shown in FIG. 4 do not necessarily suggest that the braking system 500 seen in FIG. 16 is integrated into the manual treadmill depicted in FIG. 4, rather, the section line 16-16 is included in FIG. 4 to show one potential location for the integration of a braking system into a manual treadmill according to the various innovations disclosed herein. The braking system 500 includes a pulley 502 mounted to a rear shaft assembly 504 generally opposite a front shaft assembly, both shaft assemblies having running belt pulleys that are substantially the same size. A belt 506 rotationally couples the pulley 502 to an idler pulley 508. The idler pulley 508 is configured to be adjustable so that it may be moved towards or away from the pulley 502 along an axis generally parallel to the longitudinal axis 18. Though, it should be noted that the idler pulley may be moved relative to the pulley 502 mounted to the rear shaft assembly along an axis other than one generally parallel to the longitudinal axis 18.

By adjusting the position of the idler pulley 508 relative to the pulley 502, one can adjust the friction between the belt 506 and the pulleys 502, 508. Moving the idler pulley 508 away from the pulley 502, increases the tension in the belt 506, and, accordingly, increases the friction between the belt 506 and the pulleys 502, 508. Moving the idler pulley 508 toward the pulley 502, decreases the tension in the belt 506, and, accordingly, decreases the friction between the belt 506 and the pulleys 502, 508.

Similar to the discussion of braking system 400, increasing the friction between the belt 506 and the pulleys 502, 508, increases the differential between the rotation of the rear shaft assembly to which the braking system 500 is coupled and the front shaft assembly. As a corollary, decreasing the friction between the belt 506 and the pulleys 502, 508, decreases the differential between the rotational velocity of the rear shaft assembly 504 and the front shaft assembly. As discussed above, the greater the differential, the greater the length of the excess that the front running belt pulleys push rearward.

Figure 17:
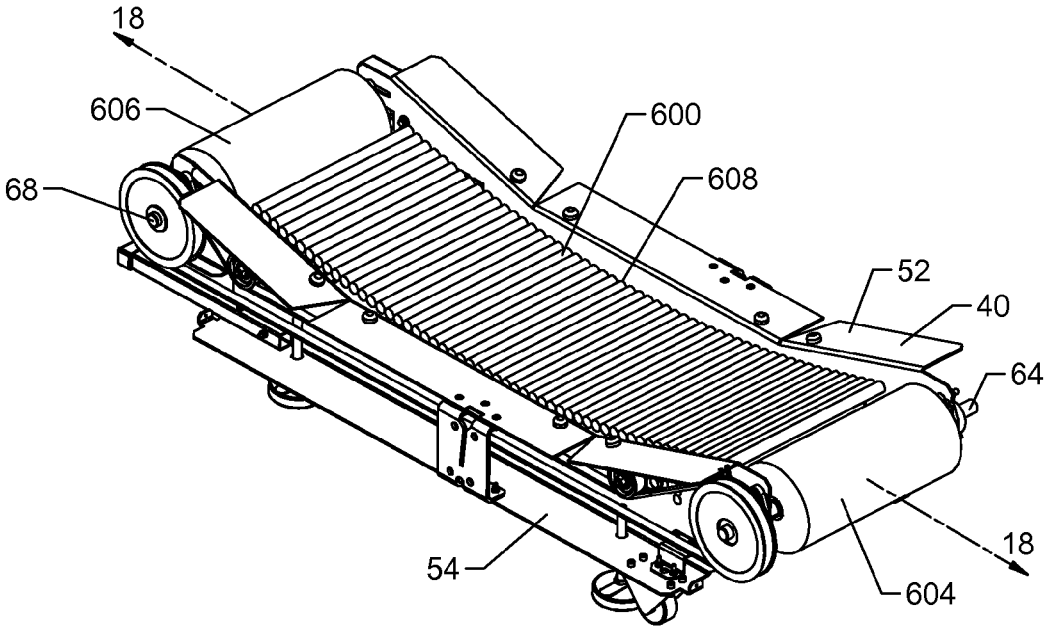
FIG. 17 is a perspective side view of a portion of the manual treadmill according to the exemplary embodiment shown in FIG. 1 including a plurality of rollers used in place of bearing rails.

FIG. 17 illustrates another exemplary embodiment of a running belt retention system of the treadmill 10 used to help induce and maintain the running belt in a desired non-planar shape to define the running surface. The treadmill 10 is shown including a plurality of rollers 600 used to support the running belt 16 in place of bearing rails 200, discussed above.

The each roller 600 is shown extending laterally generally between the left-hand side member 52 and the right-hand side member 54 of the frame 40. Along the longitudinal axis 18, the rollers 600 are disposed adjacent to one another generally between one or more front running belt pulleys 604 and one or more rear running belt pulleys 606. Typically, the running belt used with this exemplary embodiment is a continuous polymer belt without slats; the use of a continuous polymer belt having greater flexibility in the lateral direction than running belt 16 improves the ease of movement of the running belt along the rollers 600. However, other suitable continuous belts may be used according to other exemplary embodiment In the exemplary embodiment shown, the one or more front running belt pulleys is shown as a single, front running belt pulley 604 that is substantially a large roller, disposed at the front end 48 of the frame 40. Similarly, the one or more rear running belt pulleys is shown as a single, rear running belt pulley 606 that is a substantially a large roller, disposed at the rear portion of the frame 40. According to other exemplary embodiments, any multiple of running pulleys may be used at one or both of the front end and the rear end, such as front running belt pulleys 62.

Collectively, the rollers 600 define a top profile 608 similar to the top profile 210 defined by the bearing rails 200, discussed above, and provide for a running belt to move therealong. Similar to the top profile of the bearing rails, the top profile 608 defined by the rollers may be varied (e.g., may include a convex portion and a concave portion, may be modeled by a third-order polynomial, may be modeled by a fourth-order polynomial, etc.).

The front and rear running belt pulleys 604, 606 and the rollers 600 help define the running surface. In use, the running belt is disposed over the front running belt pulley 604, along the top profile 602 defined by the rollers 600, and over the rear running belt pulley 606. The running belt is maintained in a position substantially along these elements primarily by the weight of the running belt; however, according to other exemplary embodiments, a synchronizing system may also be used to ensure that the running belt is maintained in the desired position.

Referring to FIGS. 18-21, an embodiment of a running belt retention system including a track system 700 and configured to help induce and maintain the running belt in a desired non-planar shape to define the running surface according to an exemplary embodiment.

A treadmill according to this exemplary embodiment does not include front and rear shaft assemblies or bearing rails, but, rather, includes a pair of opposed tracks 702 configured to provide for movement of a running belt 16 therealong. The tracks 702 are spaced apart, generally define the path that the running belt 16 will travel, and substantially replicate at least a portion of the running surface. Each track 702 includes a side support wall 708 and a guide portion 710 generally centrally-disposed along the side support wall 708. The guide portion 710 extends from an inner side 712 of the side support wall 708 towards the interior of the treadmill frame, defined generally between the left-hand side member and the right-hand side member. The guide portion 710 generally defines the contour of the running surface that is defined by the running belt 16 when coupled to the tracks 702. An outer side 714 each side support wall 708 is disposed substantially adjacent to an inner surface of one of the side members of the treadmill frame.

A plurality of roller or wheel assemblies 716 are connected with, preferably mounted directly to or integral with, each of a plurality of slats 228 of the running belt 16. Each a laterally-oriented slat 228 includes a left-hand end 252 generally opposite a right-hand end 254. One of a plurality of wheel assemblies 716 is coupled at each end 252, 254 of each slat 228 at an interior surface 256. The wheel assemblies 716 are configured to be mated with the tracks 702 and provide for motion of the running belt 16 along the tracks 702.

Each wheel assembly 716 is shown including first roller or wheel 720 and a second roller or wheel 722 rotatably coupled to a support shown as an elongated connecting member 724. The connecting member 724 connects each wheel assembly 716 to a slat 228 and maintains the relative position of the first wheel 720 and the second wheel 722. When coupled to the track 702, the first wheel 720 of a wheel assembly 716 is disposed to one side the guide portion 710 and rotatably movable therealong, and the second wheel 722 of the wheel assembly 716 is disposed generally opposite the first wheel 720 to the other side of the central guide portion 710.

The wheels 720, 722 and the tracks 702 are shaped such that when they are mated, the wheels 720, 722 cannot be pulled inwardly off of or pushed outwardly off of the track 702. In the exemplary embodiment shown, the guide portion 710 is shown having a substantially-circular cross section 724 and the wheels 720, 722 are shown having circumferentially-disposed arcuate depressions 726 that receive and travel along an outer curved portion 728 and an inner curved portion 730 of the guide portion 710 of the track 702. According to other exemplary embodiments, the wheels and the track guide portion can have substantially any corresponding shapes that provide for the wheels and the track to mate and that provide for movement of the wheels therealong.

When the running belt 16 is being driven by a user, the interaction of the guide portion 710 and the first and second wheels 720, 722 helps maintain the belt in the desired non-planar shape. As mentioned above, the tracks 702 generally defines the contour of the running surface defined by the running belt 16. Being coupled to the guide portion 710 of the track 702, each wheel assembly 716 rotates about the track 702, following the contour defined thereby.

If the running belt 16 began to deviate from the desired path, the interaction between the wheels 720, 722 and the guide portion 710 would substantially prevent undesirable shifting. While being rotatably coupled to the elongated connecting member 724, the axes 732 and 734 of the first wheel 720 and second wheel 722, respectively, are a fixed distance apart. Further, the arcuate depressions 726 of the wheels 720, 722 are in contact with the outer curved portion 728 and inner curved portion 730, respectively. Thus, as a result the interactions between the arcuate depressions 726 and the curved portions 728, 730, any movement of a wheel assembly 716 relative to the track 702 other than along the path defined by the track 702 is countered by a force from the guide portion 710. It should also be noted that the interactions between the depressions 726 of adjacent wheel assemblies 716 and the curved portions 728, 730 of the track 702 may also help keep a wheel assembly 716 in place.

Figure 23:
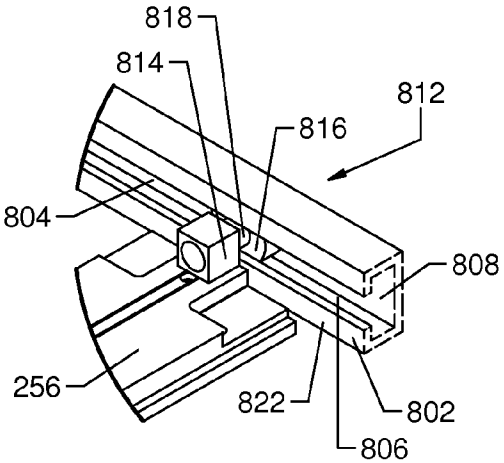
FIG. 23 is a detail view of the track system of FIG. 22 taken along line 23-23.
Figure 22:
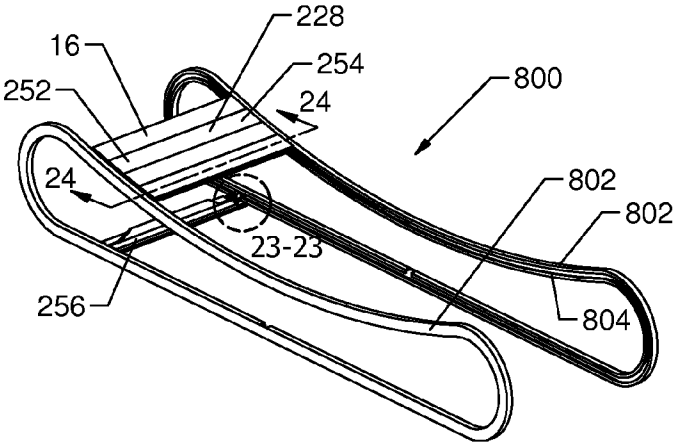
FIG. 22 is a side perspective view of another exemplary embodiment of a track system for use with the exemplary embodiment of a manual treadmill shown in FIG. 1 and configured to help induce and maintain a running belt in a desired non-planar shape to define a running surface.
Figure 24:
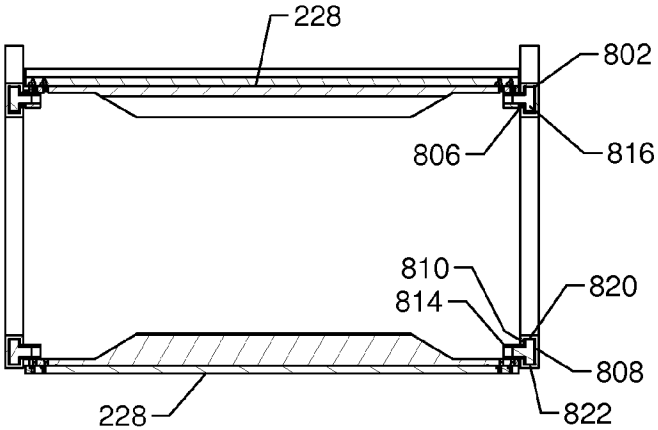
FIG. 24 is a partial cross-sectional view of the track system of FIG. 18 taken along line 24-24.
Figure 25:
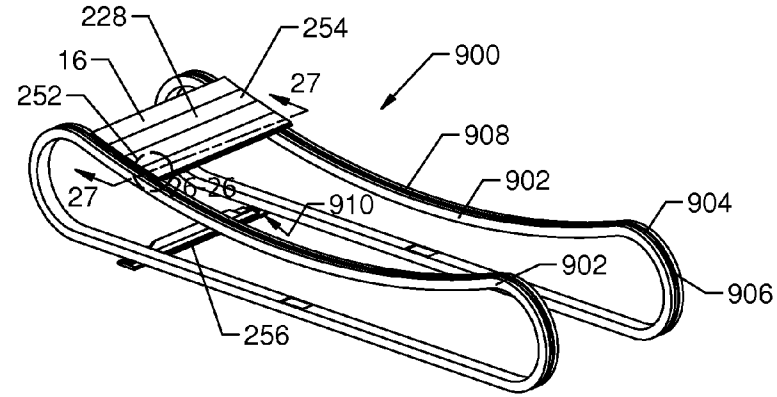
FIG. 25 is a side perspective view of another exemplary embodiment of a track system for use with the exemplary embodiment of a manual treadmill shown in FIG. 1 and configured to help induce and maintain a running belt in a desired non-planar shape to define a running surface.
Figure 26:
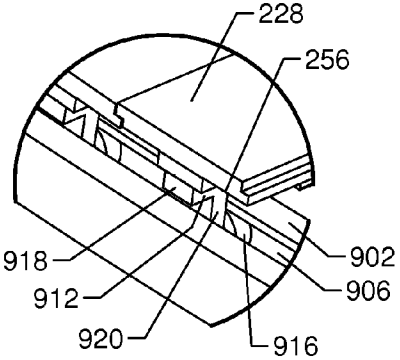
FIG. 26 is a detail view of the track system of FIG. 25 taken along a line 26-26.
Figure 27:
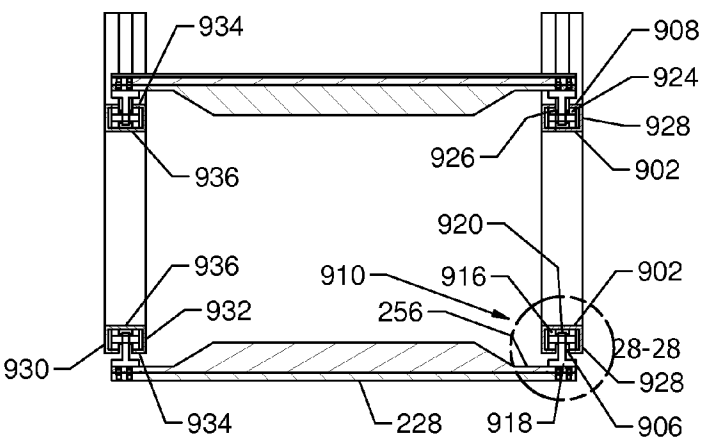
FIG. 27 is a partial cross-sectional view of the track system of FIG. 25 taken along line 27-27.
Figure 28:
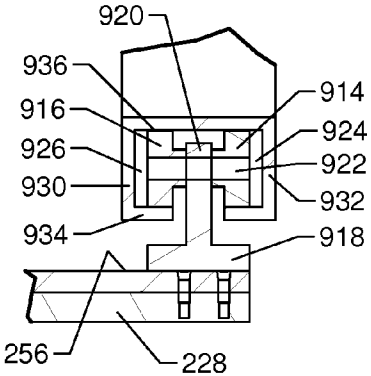
FIG. 28 is a detail view of the track system of FIG. 27 taken along line 28-28.

Referring to FIGS. 22-24, the treadmill 10 is shown including another exemplary embodiment of a track system configured to help induce and maintain the running belt in a desired non-planar shape to define the running surface, shown as a track system 800. Similar to track system 700, a treadmill according to this exemplary embodiment does not include front and rear shaft assemblies or bearing rails, but, rather, includes a pair of tracks 802 configured to provide for movement of a running belt 16 therealong. In this exemplary embodiment, each track 802 is shown as an elongated member having a substantially C-shaped cross section that defines a channel 804 having an opening 806 that faces the interior of the frame 40. An outer wall 808 each of the tracks 802 is disposed substantially adjacent to an inner surface of a left-hand or right-hand side member 52, 54 (shown, e.g., in FIG. 2) such that the openings 806 face each other. The outer wall 808 is substantially opposite an inner wall 810

As discussed above, the running belt 16 includes a plurality of laterally-oriented slats 228 each having a left-hand end 252 generally opposite a right-hand end 254. One of a plurality of roller or wheel assemblies 812 is coupled at each end 252, 254 of each slat 228 to mate with the tracks 802 and to provide for motion of the running belt 16 along the tracks 802.

Each wheel assembly 812 is shown including a support shown as a mounting block 814 and a wheel 816 rotatably coupled to the mounting block 814. The mounting block 814 mounted to an interior surface 256 of a slat 228. The wheel 816 is supported relative to the mounting block 814 by an axis 818 that extends substantially parallel to the slats 228 to facilitate positioning the wheel 816 in the channel 804. The wheel 816 is received in the channel 804 and is rotatably movable therewithin to facilitate travel of the running belt 16 along the contour defined by the channel 804. The shape of the channel 804 generally corresponds to the shape of the wheel 816.

When the running belt 16 is being driven by a user, the walls of the track 802 defining the C-shaped channel 804 help forcibly retain the wheel 816 therein, preventing the wheel from moving in any direction other than along the contour defined by the channel 804, and, thereby, maintaining the running belt 16 in the desired non-planar shape to define the running surface. The outer wall 808 and the inner wall 810 limit the side-to-side, lateral movement of the wheel 816 when it is disposed in the channel 804. Limiting the motion of the wheel 816, similarly limits the motion of the wheel assembly 812 and the slat 228 fixed relative thereto. Further, a first wall 820 substantially opposite a second wall 822 substantially limits the up-and-down motion of the wheel 816 relative to the channel 804. In circumstances where side-to-side and/or up-and-down motion of the wheel 816 occurs, the walls 808, 810, 820, 822 defining the channel 804, providing counter forces to maintain the wheel 816 in the desired position and help direct the wheel 816 along the desired path.

Referring to FIGS. 25-28, the treadmill 10 is shown including still another exemplary embodiment of a track system configured to help induce and maintain the running belt in a desired non-planar shape to define the running surface, shown as a track system 900. Similar to track system 800, the treadmill according to this exemplary embodiment does not include bearing rails, but, rather, includes a pair of tracks 902 configured to provide for movement of a running belt 16 therealong. In this exemplary embodiment, each track 902 is shown as an elongated member having a substantially C-shaped cross section that defines a channel 904 having an opening 906 that faces the exterior of the track 902. Stated otherwise, each channels 904 extend about an outer periphery 908 of a tracks 902.

As discussed above, the running belt 16 includes a plurality of laterally-oriented slats 228 each having a left-hand end 252 generally opposite a right-hand end 254. One of a plurality of roller or wheel assemblies 910 is coupled at each end 252, 254 of each slat 228 to mate with the tracks 902 and to provide for motion of the running belt 16 along the tracks 902.

Each wheel assembly 910 is shown including a support shown as a connecting bar 912 that is substantially T-shaped and connected to a first wheel 914 and a second wheel 916. A first portion 918 of the connecting bar 912 is fixed relative to the interior surface 256 of a slat 228. A second portion 920 extends substantially perpendicular to the first portion 918 and away from the interior surface 256 of the slat 228. The first wheel 914 and the second wheel 916 are connected to the connecting bar 912 by an axis 922 that extends generally parallel to the first portion 918 and perpendicular to the second portion 920 of the connecting bar 912. The first wheel 914 is disposed to one side of the second portion 920 of the connecting bar 912 and the second wheel 916 is disposed opposite the first wheel 914 to the other side of the second portion 920.

When the wheel assemblies 910 are mated with the tracks 902, the second portion of the connecting bar 912 extends partially into the channel 904, the first wheel 914 is received within a first portion 924 of the channel 904 and the second wheel 916 is disposed within a second portion 926 of the channel 904. The first portion 924 of each channel 904 is disposed proximate to an outer surface 928 of the track 902 relative to the second portion 926.

When the running belt 16 is being driven by a user, the first wheel 914 and the second wheel 916 of a given wheel assembly rotate within the channel 904, facilitating moment of the running belt 16 in the path defined by the track 902. As the running belt 16 is rotated, the slats 228 are disposed generally exterior to the periphery 908 of the track 902. The walls of the track 902 defining the channel 904 help forcibly retain the wheels 914, 916. An outer wall 930 and an inner wall 932 limit the side-to side movement of the wheels 914, 916, either by coming into contact with the wheels 914, 916 themselves or by coming into contact with another part of the wheel assembly 910 (e.g., the connecting bar 912). Limiting the motion of the wheels 914, 916 and the wheel assembly 910 similarly limits the motion of the slat fixed relative thereto, helping each slat, and, thereby, the running belt 16 to follow the desired path. Further, a first wall 934 substantially opposite a second wall 936 substantially limits the up-and-down motion of the wheels 914, 916 relative to the channel 904. In circumstances where side-to-side and/or up-and-down motion of the wheel 916 occurs, the walls 930, 932, 934, 936 defining the channel 904, providing counter forces to maintain the wheels 914, 916 in the desired position and help direct the wheels 914, 916 along the desired path.

Figure 29:
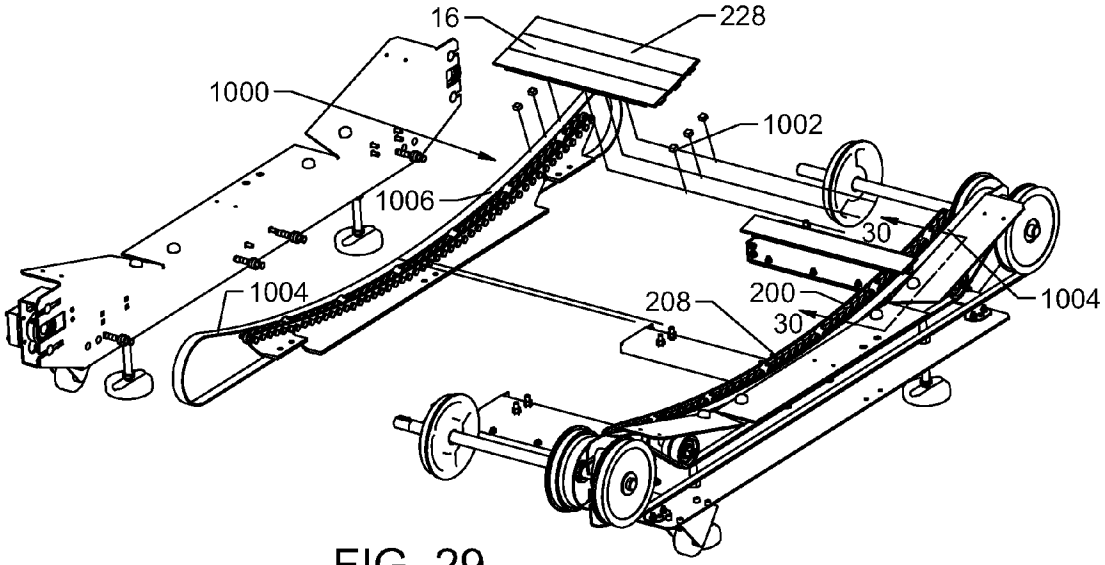
FIG. 29 is a partially exploded, right-hand perspective view of a track system for use with the exemplary embodiment of a manual treadmill shown in FIG. 1 and configured to help induce and maintain a running belt in a desired non-planar shape to define a running surface.
Figure 30:
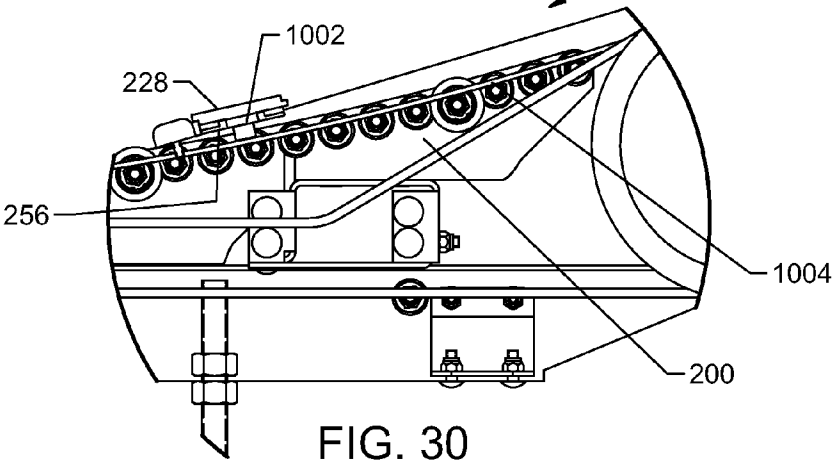
FIG. 30 is a detail view of the track system of FIG. 29 taken along line 30-30.
Figure 32:
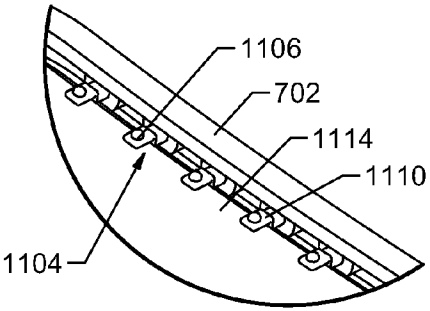
FIG. 32 is a detail view of the track system of FIG. 31 taken along a line 32-32.
Figure 34:
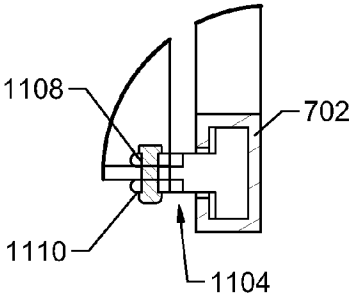
FIG. 34 is a detail view of the track system of FIG. 32 taken along a line 34-34.
Figure 31:
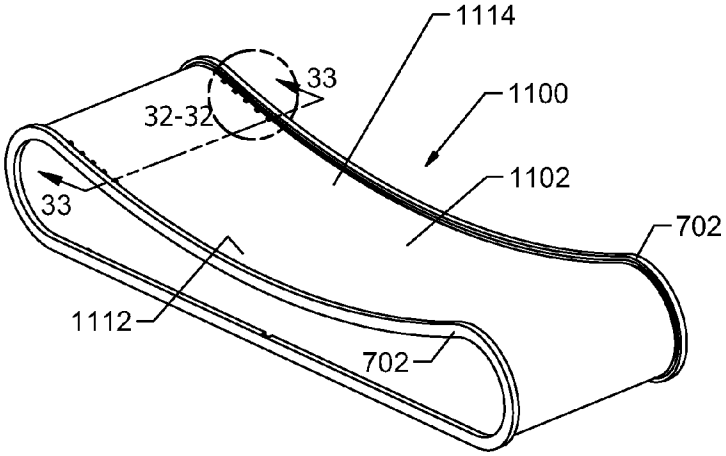
FIG. 31 is a side perspective view of another exemplary embodiment of a track system for use with the exemplary embodiment of a manual treadmill shown in FIG. 1 and configured to help induce and maintain a running belt in a desired non-planar shape to define a running surface.
Figure 33:
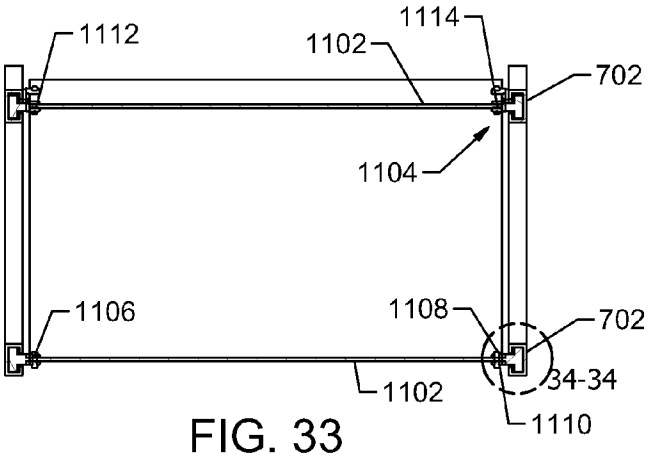
FIG. 33 is a partial cross-sectional view of the track system of FIG. 31 taken along a line 33-33.

Referring to FIGS. 29-30, the treadmill 10 is shown including another exemplary embodiment of a track system configured to help induce and maintain the running belt in a desired non-planar shape to define the running surface, shown as a track system 1000.

Instead of using wheel assemblies, such as 716 and 910, discussed above, the treadmill according to this exemplary embodiment utilizes a plurality of magnets 1002 to maintain the running belt 16 in the desired position. One or more magnets 1002 are fixed relative to the interior surface 256 of the slats 228 at locations substantially corresponding to the position of a track 1004, which is typically along the left-hand end 252 and the right-hand end 254 of the slats 228. The magnets 1002 may be coupled by any variety of fasteners or fastening mechanisms. Generally, it is preferable that, when the magnets 1002 are fixed relative to the slats, the fasteners do not directly contact the periphery 1006 of the tracks 1004 to avoid scratching and damage thereto. While it is generally desirable to mount a magnet 1002 to each slat, 228, the number of magnets used will vary depending upon a variety of factors such as the relative weight of the belt and the relative magnetic strength of each magnet.

The magnets 1002 are configured to magnetically couple the running belt 16 to the track 1004, which is made of metal (e.g., steel) or includes a peripheral metal portion. The magnets 1002 have strength suitable to maintain the running belt 16 in close proximity to a periphery 1006 of the tracks 1004.

When the treadmill is driven by a user, the force imparted to the running belt 16 is sufficient to permit the magnets to move relative bearing rails, but not to lose the magnetic connection therebetween. According to one exemplary embodiment, as the running belt 16 moves relative to the track 1004, the magnets 1002 are generally spaced a small distance from the periphery 1006 of the track 1004, helping to further reduce the noise associated with operation of the treadmill. According to other exemplary embodiments, the magnets 1002 are in physical contact with the periphery 1006 of the track 1004 in addition to being magnetically coupled thereto.

According to an exemplary embodiment similar to track system 1000, a plurality of magnets may be positioned on the frame, track, or other fixed component of the treadmill base to apply a downwardly-directed force to the metal slats of the running belt as it passes over the magnets. For example, the magnets may be positioned on the cross-members 56. As the running belt rotates, the portion passing above the magnets will be drawn downward by the force of the magnets, helping maintain that portion of the running belt (i.e., defining the running surface) in the desired shape.

Referring to FIGS. 31-34, the treadmill 10 is shown including another exemplary embodiment of a track system configured to help induce and maintain the running belt in a desired non-planar shape to define the running surface, shown as a track system 1100.

The track system 1100 is substantially similar to track system 700, but configured to be operable with a running belt 1102 that is a conventional running belt rather than a slatted running belt 16. The track system 1100 includes a pair of tracks 702 and a wheel assemblies 1104 having substantially the same configuration as wheel assembly 716 with the exception that a securing device shown as a clip 1106 is used to connect the wheel assembly 1104 to the running belt 1102, rather than the elongated connecting member 724. The clip 1106 is shown extending and having a first portion 1108 and a second portion 1110 that opening towards the interior of the treadmill 10 before being secured. When the running belt 1102 shown as a continuous polymer (e.g., urethane) belt is in position, a first edge 1112 of the running belt 1102 is received between a first portion 1108 and a second portion 1110 of the clip 1106 and fixed relative thereto (e.g., by a fastener, etc.). The polymer belt is a urethane belt according to an exemplary embodiment. The urethane belt is desirable heavy enough to help assume the shape of the rollers, but not so thick or heavy that it undesirably impedes movement. The clips extend along the first edge 1112 and the second edge 1114 of the running belt 1102, substantially suspending the belt between the tracks 702. According to an exemplary embodiment, the securing device may be any securing device suitable for securing an edge portion of the running belt 1102 relative thereto (e.g., a bolt, a clamp, etc.).

According to still another exemplary embodiment, a treadmill has a track system including a pair of tracks and wheel assemblies. The wheel assemblies include hangers (e.g., magnetic hangers) that are received in channels that are interior to the track, the hangers being slidably movable within the channels. According to one exemplary embodiment, the hangers are substantially I-shaped, having one transverse portion received in the channel and the other transverse portion fixed to an interior side of a slat. According to some exemplary embodiments, the system further includes bearing rails that facilitate motion of the running belt itself and the hangers within the track. The hangers and the channel of the track may have any configuration suitable for facilitating movement of the running belt and maintaining the running belt in the desired non-planar shape.

Figure 35:
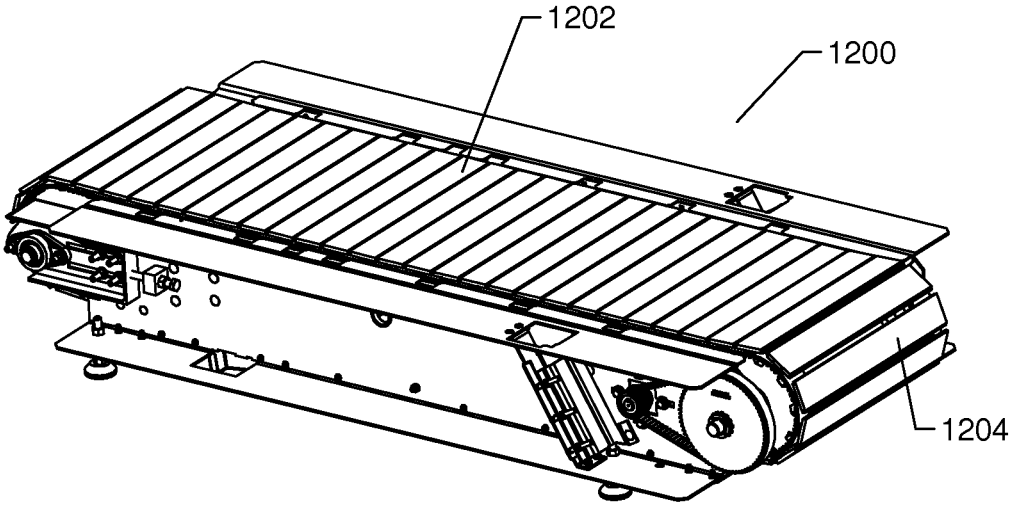
FIG. 35 is a perspective view of an exemplary embodiment of a manual treadmill according to another embodiment having a substantially planar running surface.

The above-described ways of inducing and maintaining the running belt in the desired non-planar shape can also be used with or adapted to a manual treadmill having a planar running surface, such as treadmill 1200 having planar running surface 1202 shown in FIG. 35. The treadmill 1200 is shown substantially similar to treadmill 10, but the running surface is substantially planar. Accordingly, the ability to manually drive the treadmill is substantially dependent on the incline of the running surface 1202 relative to the ground. Ways to adjust this incline for any treadmill disclosed herein will be discussed in more detail later.

In the exemplary embodiment shown, the running surface 1202 is defined by a running belt 1204 that is disposed about front and rear running belt pulleys of a front and rear shaft assembly, respectively. The running belt 1204 also travels along a pair of bearing rails having a substantially linear top profile that facilitate motion of the running belt 1204.

As discussed above, the speed controls for the manual treadmill 10 and the various embodiments thereof are generally the user's cadence and relative position of her weight-bearing foot on the running surface. More generally, the running belt 16 of the treadmill 10 is responsive to the weight of the user mounting, dismounting, or running on the treadmill 10. While it is generally desirable for the running belt 16 to be moved rearward, the running belt is capable of rotating forward. Forward rotation of the running belt can create safety concerns. For example, if a user were to mount the treadmill by placing her weight bearing foot at a location (e.g., location D shown in FIG. 5) along the rear portion 74 of the running surface 70, the running belt 16 may move forward and cause them to loose their footing, resulting in an injury or simply an unpleasant user experience.

Figure 36:
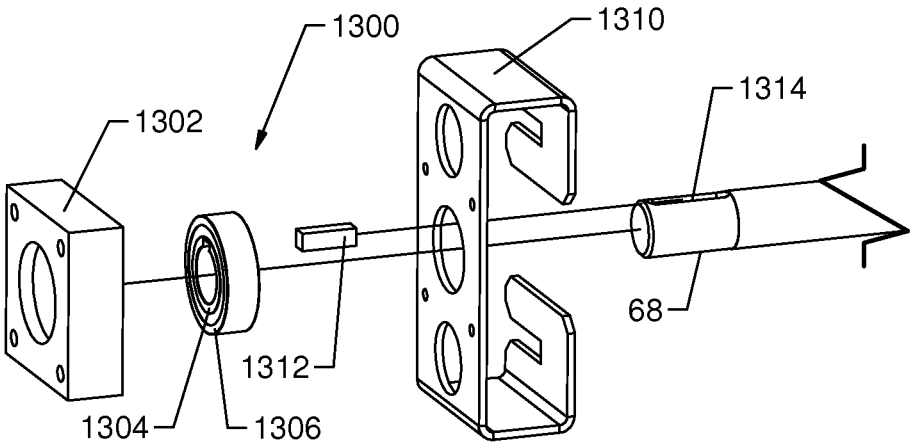
FIG. 36 is a perspective view of a one-way bearing for the manual treadmill according to the exemplary embodiment shown in FIG. 1.

A number of safety devices may be used with the treadmill 10 to help prevent undesirable forward rotation of the running belt 16. FIG. 36 illustrates a safety device shown as a one-way bearing assembly 1300 according to an exemplary embodiment. The one-way bearing assembly 1300 is a motion restricting element that is configured to permit rotation of at least one of the front and rear shaft assemblies 44, 46 (and hence the running belt 16) in only one direction, preferably clockwise as seen in FIGS. 1 and 5.

Figure 2:
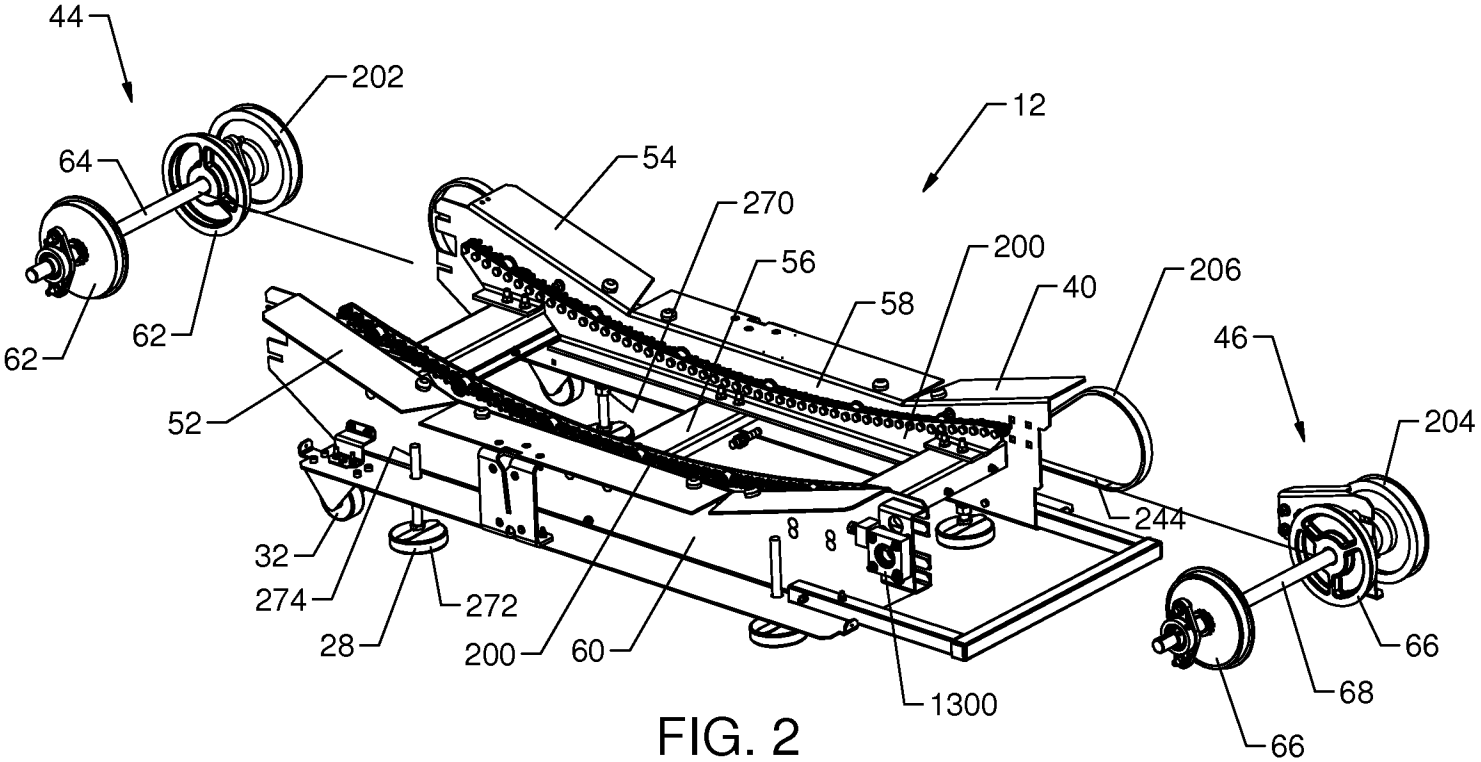
FIG. 2 is a left-hand partially exploded perspective view of a portion of the manual treadmill according to the exemplary embodiment shown in FIG. 1.

In the exemplary embodiment shown, the one way bearing assembly 1300 is disposed about and cooperates with the rear shaft 68 as shown in FIG. 2. The one-way bearing assembly 1300 comprises a housing 1302 which supports an inner ring 1304 that cooperates with the rear shaft 68 and supports an outer ring 1306 fixed relative to the housing 1302. A plurality of sprags (not shown) are disposed between the inner ring 1304 and the outer ring 1306. The sprags are asymmetric, and, thus, provide for motion in one direction and prevent rotation in the opposite direction. The housing 1302 is fixed to a bracket 1310 that is connected to, and preferably directly mounted to, the frame 40 to fix the location of the housing 1302 and prevent movement of the housing 1302 in response to the rotation of the rear shaft 68. It should be noted that the location at which the bracket 1310 is mounted to the frame 40 can be adjusted depending on the location of the rear shaft 68, which may change depending on the shape of the non-planar running surface or the desired tension in the running belt. According to another exemplary embodiment, the one-way bearing may be transitionally fit into the housing, rather than press fit. According to yet another exemplary embodiment, the one-way bearing may include rollers in addition to sprags.

The one-way bearing assembly 1300 further includes a key 1312 that is fixed relative to the inner ring 1304 and configured to cooperate with a keyway 1314 formed in the rear shaft 68. Viewed from the perspective shown in FIGS. 1 and 5, when the running belt 16 is moving rearward, rotating in the clockwise direction, the rear shaft 68 similarly rotates in the clockwise direction. The inner ring 1304 of the one-way bearing assembly 1300 rotates with rotational velocity corresponding to the rotational velocity of the rear shaft 68 because of the interaction between the key 1312 and the keyway 1314. If a force is applied by the user to the running belt 16 that urges the rear shaft 68 to rotate counterclockwise, the one-way bearing assembly 1300 provides a counter force, preventing the counterclockwise rotation of the rear shaft 68 and the forward rotation of the running belt 16. Specifically, as the rear shaft 68 begins to move counterclockwise, the interaction of the key 1312 and the keyway 1314 begins to drive the inner ring 1304 of the one-way bearing assembly 1300 rearward. The sprags become wedged between the inner ring 1304 and the outer ring 1306, preventing the counterclockwise rotation of the inner ring and key 1312 disposed therein. The key 1312, by virtue of its inability to rotate, provides a counterforce to the keyway 1314 as the keyway continues to attempt to rotate counterclockwise. By preventing the keyway 1314 from moving counterclockwise, the one-way bearing assembly 1300 thus prevents the rear shaft 68, the rear running belt pulleys 66, and running belt 16 from rotating counterclockwise as seen in FIGS. 1 and 5.

Figure 38:
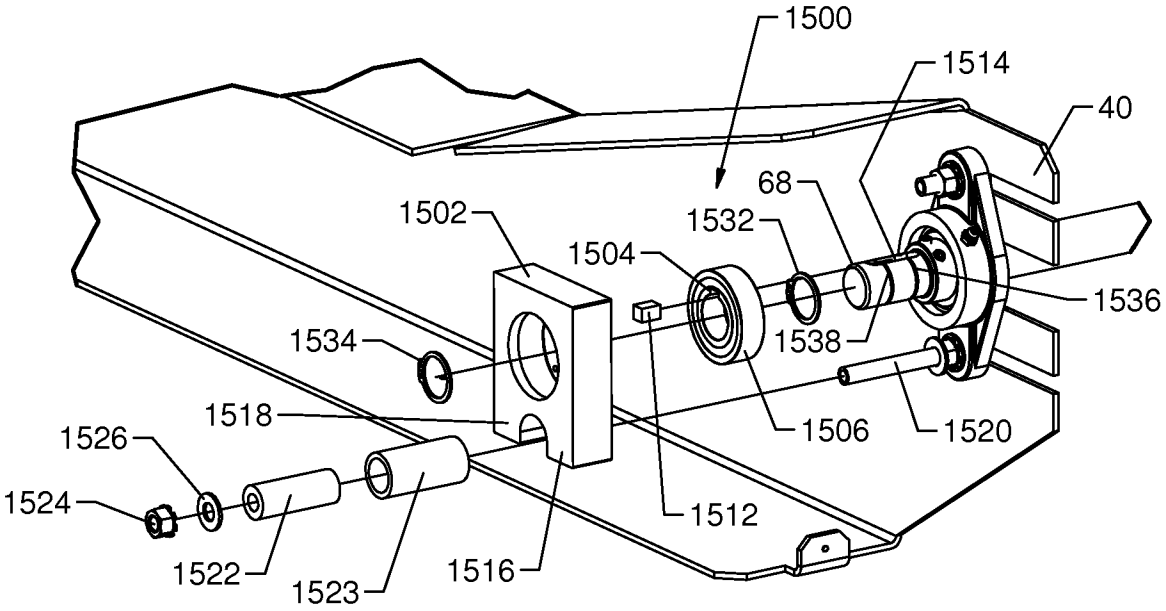
FIG. 38 is a perspective view of a one-way bearing for the manual treadmill shown in FIG. 1, according to another embodiment.

FIG. 38 illustrates another safety device that may be used with the treadmill 10, shown as a one-way bearing assembly 1500 according to an exemplary embodiment. The one-way bearing assembly 1500 is a motion restricting element that is configured to permit rotation of at least one of the front and rear shaft assemblies 44, 46 (and hence the running belt 16) in only one direction, preferably clockwise as seen in FIGS. 1 and 5.

In the exemplary embodiment shown, the one-way bearing assembly 1500 is disposed about and cooperates with the rear shaft 68. The one-way bearing assembly 1500 comprises a housing 1502 which supports an inner ring 1504 that cooperates with the rear shaft 68 and supports an outer ring 1506 fixed relative to the housing 1502. A plurality of sprags (not shown) are disposed between the inner ring 1504 and the outer ring 1506. The sprags are asymmetric, and, thus, provide for motion in one direction and prevent rotation in the opposite direction. The one-way bearing assembly 1500 is further shown to include a first snap ring 1532 and a second snap ring 1534, which are configured to seat in a first circumferential groove 1536 and a second circumferential groove 1538 on the rear shaft 68, respectively. When installed, the first snap ring 1532 is supported inboard of and adjacent to the inner ring 1504, and the second snap ring 1534 is supported outboard of and adjacent to the inner ring 1504, thereby further restricting axial motion of the one-way bearing assembly 1500 relative to the rear shaft 68.

The housing 1502 is supported by a stud 1520 which is coupled to the frame 40. The stud 1520 may be separated or spaced apart from the housing 1502 by a spacer 1522 and a sleeve 1523 which may be restrained on the stud 1520 by a nut 1524 and a washer 1526. The sleeve 1523 of the embodiment shown is formed of rubber and is configured to reduce noise, wear, and shock load between the housing 1502 and the stud 1520 and/or the spacer 1522. The housing 1502 includes a plurality of legs, shown as a first leg 1516 and a second leg 1518, which extend on either side of the stud 1520. Accordingly, the stud 1520 resists rotational motion of the housing 1502 in response to rotation of the rear shaft 68 and may provide sufficient reactive or counter force to the housing 1502 to enable the one-way bearing assembly 1500 to prevent counterclockwise rotation of the rear shaft 68. Supporting the one-way bearing assembly 1500 in this manner negates the need for fixing the housing 1502 to the frame 40 or an intermediary bracket. Accordingly, the housing 1502 may move with the rear shaft 68 (e.g., the housing 1502 may pivot about the stud 1520) as the rear shaft 68 flexes under load, thereby reducing side loading on the inner ring 1504, which in turn reduces wear on, and extends the life of, the one-way bearing assembly 1500.

It should be noted that the location at which the stud 1520 is mounted to the frame 40 can be adjusted depending on the location of the rear shaft 68, which may change depending on the shape of the non-planar running surface or the desired tension in the running belt. Furthermore, the stud 1520 need not be positioned below or downward from the rear shaft 68, as shown, but may be located in any direction relative to the rear shaft 68. According to another exemplary embodiment, the one-way bearing may be transitionally fit into the housing, rather than press fit. According to yet another exemplary embodiment, the one-way bearing may include rollers in addition to sprags.

The one-way bearing assembly 1500 further includes a key 1512 that is fixed relative to the inner ring 1504 and configured to cooperate with a keyway 1514 formed in the rear shaft 68. Viewed from the perspective shown in FIGS. 1 and 5, when the running belt 16 is moving rearward, rotating in the clockwise direction, the rear shaft 68 similarly rotates in the clockwise direction. The inner ring 1504 of the one-way bearing assembly 1500 rotates with rotational velocity corresponding to the rotational velocity of the rear shaft 68 because of the interaction between the key 1512 and the keyway 1514. If a force is applied by the user to the running belt 16 that urges the rear shaft 68 to rotate counterclockwise as seen in FIGS. 1 and 5, the one-way bearing assembly 1500 provides a counter force, preventing the counterclockwise rotation of the rear shaft 68 and the forward rotation of the running belt 16. Specifically, as the rear shaft 68 begins to move counterclockwise, the interaction of the key 1512 and the keyway 1514 begins to drive the inner ring 1504 of the one-way bearing assembly 1500 rearward. The sprags become wedged between the inner ring 1504 and the outer ring 1506, preventing the counterclockwise rotation of the inner ring and key 1512 disposed therein. The key 1512, by virtue of its inability to rotate, provides a counterforce to the keyway 1514 as the keyway continues to attempt to rotate counterclockwise. By preventing the keyway 1514 from moving counterclockwise, the one-way bearing assembly 1500 thus prevents the rear shaft 68, the rear running belt pulleys 66, and running belt 16 from rotating counterclockwise as seen in FIGS. 1 and 5.

Other safety devices to help prevent undesirable forward rotation of the running belt 16 may include cam locking systems, which may be particularly well-suited for use in conjunction with track systems 700, 800, and 900. Also, taper locks, a user operated pin system, or a band brake system with a lever may be utilized.

Controlling the operation of the running belt 16 in ways in addition to preventing rearward rotation, can help improve the safety of the treadmill and/or help a user adjust the treadmill for a desirable level of performance. Including an incline or elevation adjustment system is one way to provide these benefits. As mentioned above, as the increasing or decreasing of the relative height or distance of the running surface relative to the ground is one way that the operation, most typically the speed, of the treadmill can be adjusted. Accordingly, adjusting the incline of the base of the treadmill results in an adjustment to the speeds a user can achieve and/or how easy or challenging it is for the user to achieve certain speeds.

Referring back to FIGS. 1-6, a plurality of nuts 270 are fixed, and more preferably welded, to the bottom of the frame 40 allow the feet 28 to be adjusted. The feet 38 include a lower or base portion 272 and a threaded shaft 274 extending vertically upward from the base portion 272 according to an exemplary embodiment. Generally, by increasing the distance between the nuts 270 and the base portions 272 of the feet 28 at the front end 48 of the frame 40 relative to the rear end 50, the incline of the base 12 will increase. Stated otherwise, the angle between the longitudinal axis 18 and the ground will increase. Similarly, the distance between the nuts 270 and the base portions 272 of the feet at the rear end 50 may be decreased relative to the feet 28 at the front end 48, thereby increasing the incline. By increasing the incline, a user is typically able to achieve greater speeds on the treadmill 10.

Treadmill 1200 shown in FIG. 35 preferably has at least some incline (i.e., the longitudinal axis of the treadmill to be other than parallel to the ground) when in operation as the shape of the running surface, substantially planar, does not provide for increases and decreases in height in and of itself. On the other hand, the longitudinal axes of the treadmills having non-planar running surfaces may be parallel to the ground or at an incline thereto during operation. It should be noted that, while it is generally desirable to have the front shaft at a height at or above the height of the rear shaft, with some running surface configurations, desirable orientations can be achieved by raising the rear shaft to a location above the front shaft relative to the ground.

In some cases, the user may want to decrease the incline of the treadmill (e.g., to decrease the speeds the treadmill can achieve, etc.). For example, the user may want to utilize a relatively long stride, but does not want to be running at such high speeds. This can be accomplished by lowering the incline of the treadmill from the higher incline position. Once in the lowered position, the same stride the user was using at the higher incline position will typically result in the user running at lower speeds in the lower incline position. This same principle can also be applied for the purposes of safety. That is, keeping the front of the treadmill at a lower incline position or lowering the treadmill to a lower incline position can help prevent a user from achieving speeds that are too great for them (e.g., that would cause them to be off-balance, lose control, be injured, etc.).

Figure 37:
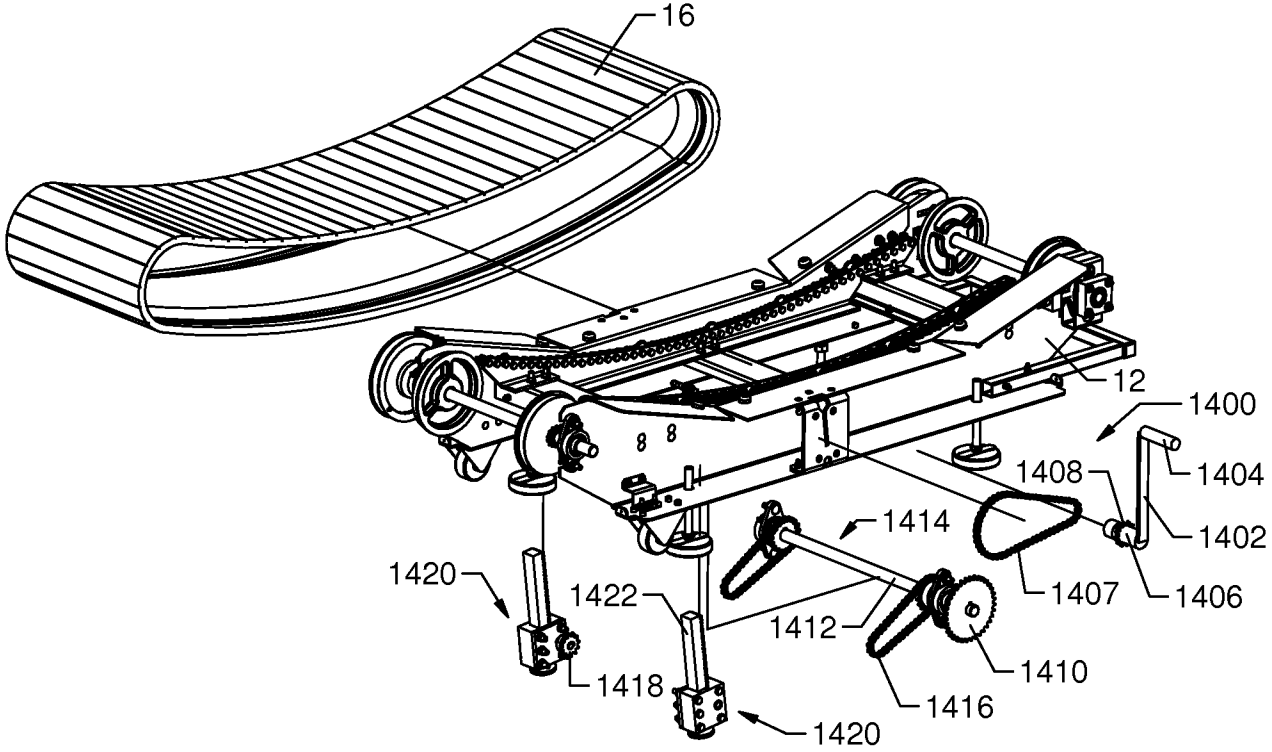
FIG. 37 is a left-hand partially exploded perspective view of a portion of the manual treadmill according to the exemplary embodiment shown in FIG. 1 including an incline adjustment system.

Because the treadmill is preferably manually operated, it does not have an external power source which can be utilized to operate a height adjusting motor as is found in conventional treadmills. Therefore, a manual height adjusting system is preferably integrated into the treadmill. Referring to FIG. 37, an example of a manual incline or elevation adjustment system 1400 is shown according to an exemplary embodiment. A hand crank 1402 configured to be operated by a person, such as the user, is provided allow a user to operate the incline adjustment system 1400 to adjust the incline of the base 12 of the treadmill 10 relative to the ground. The front shaft 64 may be lowered relative to the rear shaft 68 and/or the front shaft 64 may be raised relative to the rear shaft 68 using the hand crank 1402. In an alternative exemplary embodiment, the front shaft may be maintained at a position above the ground, and the rear shaft may be raised or lowered relative thereto adjust the incline.

Generally, the hand crank 1402 includes a handle portion 1404 disposed parallel to and spaced a distance from a shaft 1406 that is coupled to the frame 40 (e.g., with a bracket). When assembled, a drive belt or chain 1407 is disposed about a gear 1408 that is positioned about the shaft 1406 of the hand crank 1402. Rotational motion can be imparted to the gear 1408 by rotating the handle portion 1404. In response to rotation of the gear 1408, the drive belt 1407 causes a sprocket 1410 is fixed relative to an internal connecting shaft 1412 of the internal connecting shaft assembly 1414 to rotate. The internal connecting shaft assembly 1414 further includes a pair of drive belts or chains 1416 that are operably coupled to gears 1418 of rack and pinion blocks 1420. The rotation of the internal connecting shaft 1412 causes the drive belts or chains 1416 to rotate gears 1418. As the gears 1418 rotate, a pinion (not shown) disposed within the rack and pinion blocks 1420 imparts linear motion to the racks 1422, thereby operably raising or lowering the base 12 of the treadmill 10 depending on the direction of rotation of the handle portion 1404 of the hand crank 1402.

According to another exemplary embodiment, an incline adjustment system that is a gas assisted un-weighting incline adjustment system may be utilized. According to other exemplary embodiments, any suitable linear actuator may serve as an incline adjustment system for the manual treadmill disclosed herein.

According to an exemplary embodiments, the incline of one or more portions of the running surface may be adjusted independent of adjusting the incline of the base. For example, one or more portions of a bearing rail may be configured to be movable relative to one or more other portion of the bearing rail. In one exemplary embodiment, a bearing rail is divided into a first portion and a second portion movable relative to each of the about a pivot point disposed therebetween. A person (e.g., a user, trainer, technician, etc.) can adjust the operational characteristics of the treadmill (similar to the discussion of using running surfaces having different curved profiles above) by merely adjusting the relative position of the bearing rail portions. If the user wants to achieve greater speeds, they may increase the incline of the front portion, while leaving the center and rear portions unchanged. If the user would like to alter the configuration of the treadmill to more strongly encourage running on the balls of their feet, they might increase the incline of the front and rear portions from a higher radius of curvature so that they collectively define a lower radius of curvature. Adjustments to the position of the bearing rails may be imparted using a crank, or other suitable device.

It is further contemplated that, because the treadmill 10 does not require an electric motor for operation, it is well suited for operation in an aquatic environment. For example, the treadmill 10 may be at least partially submerged in a pool, thereby providing added resistance due to hydrodynamic drag on a user and/or reducing footfall impact due to the buoyancy of the user. Accordingly, a submerged embodiment of the treadmill 10 may be used for training and/or rehabilitation purposes. Modifications may be made to the treadmill 10 for use in an aquatic environment. For example, the treadmill 10 may include sealed bearings and components formed of corrosion-resistant materials (e.g., plastic, composite, stainless steel, brass, etc.) to extend its useful life. Further, the shape of the running surface 70 may also be modified to compensate for the buoyancy of the user in water and to compensate for the effects of salinity on buoyancy. For example, it is contemplated that the shape of the running surface 70 may be different for a treadmill 10 used in a freshwater environment and a highly saline environment.

A number of other devices, both mechanical and electrical, may be used in conjunction with or cooperate with a treadmill according to this disclosure. FIG. 1, for example, shows a display 280 adapted to calculate and display performance data relating to operation of the treadmill according to an exemplary embodiment. The display 280 includes an independent power source (e.g., a battery) that provides for the display 280 to be electrically-operative. The feedback and data performance analysis from the display may include, but are not limited to, speed, time, distance, calories burned, heart rate, etc. For example, a the display may include a sensor that is responsive to the position of a magnet on one of the running belt pulleys. The sensor is configured to recognize every time the magnet rotates past (e.g., moves past, crosses, etc.) a certain location. With this data, the display may calculate the speed at which the user is running and then provide this data to them via a user interface. According to other exemplary embodiments, other displays, cup holders, cargo nets, heart rate grips, arm exercisers, TV mounting devices, user worktops, and/or other devices may be incorporated into the treadmill.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure.

It is important to note that the constructions and arrangements of the manual treadmill as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A manually operated treadmill comprising:

a treadmill frame having a front end and a rear end opposite the front end;

a front shaft rotatably coupled to the treadmill frame at the front end;

a rear shaft rotatably coupled to the treadmill frame at the rear end;

a running belt including a curved running surface upon which a user of the treadmill may run, wherein the running belt is disposed about the front and rear shafts such that force generated by the user causes rotation of the front shaft and the rear shaft and also causes the running surface of the running belt to move from the front shaft toward the rear shaft;

a safety device coupled to at least one of the front shaft and the rear shaft, wherein the safety device prevents rotation of at least one of the front shaft and the rear shaft in one direction and permits rotation of at least one of the front shaft and the rear shaft in the opposite direction to restrict rotation of the running belt in a single direction; and a synchronizing system interconnecting the front and rear shafts, wherein the synchronizing system is configured to provide a force that acts to resist differential rotation of the front and rear shafts;

wherein the treadmill is configured to allow the user to manually control the speed of the running belt and to facilitate maintenance of a contour of the curved running surface.

2. The manually operated treadmill of claim 1, wherein the front shaft is configured such that the speed of the running belt at the front shaft is greater than the speed of the running belt at the rear shaft to facilitate the running belt maintaining the curved running surface.

3. The manually operated treadmill of claim 2, further comprising:

a front pulley coupled to the front shaft; and a rear pulley coupled to the rear shaft;

wherein the running belt is supported by and contacts the front pulley and the rear pulley, wherein the radius of the front pulley is greater than the radius of the rear pulley.

4. The manually operated treadmill of claim 3, wherein the difference between the radius of the front pulley and the radius of the rear pulley is less than approximately 0.1 inches.

5. The manually operated treadmill of claim 4, wherein the difference between the radius of the front pulley and the radius of the rear pulley is between approximately 0.005 and 0.035 inches.

6. The manually operated treadmill of claim 2, further comprising a braking system configured to slow rotation of the rear shaft resulting in the greater speed of the running belt at the front shaft.

7. The manually operated treadmill of claim 1, wherein the treadmill is configured to prevent movement of the running surface of the running belt in a direction from the rear shaft toward the front shaft.

8. The manually operated treadmill of claim 7, wherein the curved running surface comprising at least a convex curved section and a concave curved section, wherein the concave curved section is located between the front shaft and the convex curved section and wherein the highest point of the convex section is above the lowest point of the concave section.

9. The manually operated treadmill of claim 1, wherein the safety device comprises a one-way bearing.

10. The manually operated treadmill of claim 7, wherein the safety device cooperates with the rear shaft to prevent movement of the running surface of the running belt in a direction from the rear shaft towards the front shaft.

11. A manually operated treadmill comprising:

a frame supported on a substantially horizontal surface;

a front shaft assembly supported by the frame and comprising:

a front shaft; and at least one front running belt pulley supported by the front shaft;

a rear shaft assembly supported by the frame a spaced distance from the front shaft and comprising:

a rear shaft; and at least one rear running belt pulley supported by the rear shaft;

a running belt supported at least in part by the front shaft assembly and the rear shaft assembly, the running belt including a front portion adjacent the front shaft assembly, a rear belt portion adjacent the rear shaft assembly, and a central belt portion intermediate the front belt portion and the rear belt portion, the front belt portion and the rear belt portion being positioned vertically higher than a lowest point found in the central belt portion to form a curved running surface upon which a user of the treadmill may walk or run, wherein gravitational force acting upon weight of the user's body on the running belt relative to the lowest point of the running belt causes rotation of the running belt, front shaft, and the rear shaft without the aid of a motor;

a safety device cooperating with the rear shaft to permit rotation of the rear shaft in only one direction; and at least one bearing rail having a plurality of bearings rotatably coupled to the at least one bearing rail and forming a top profile, the top profile defined by a front profile portion adjacent the front shaft assembly, a rear profile portion adjacent the rear shaft assembly, and a central profile portion intermediate the front profile portion and the rear profile portion, the central profile portion having a concave curve, and the front profile portion and the profile rear portion being continuations of the concave curve;

wherein the running surface of the running belt is supported by the top profile of the at least one bearing rail such that the running surface substantially corresponds to the shape of the top profile of the at least one bearing rail.

12. The manually operated treadmill of claim 11, the at least one bearing rail extending along the frame and longitudinally aligned with one of the at least one front running belt pulley and one of the at least one rear running belt pulley.

13. The manually operated treadmill of claim 12, wherein the running belt comprises a plurality of laterally extending slats.

14. The manually operated treadmill of claim 13, wherein:

the front shaft assembly comprises a second front running belt pulley supported by the front shaft and spaced laterally from the at least one front running belt pulley;

the rear shaft assembly comprises a second rear running belt pulley supported by the rear shaft and spaced laterally from the at least one rear running belt pulley;

the at least one bearing rail further comprises a second bearing rail having a plurality of bearings forming a top profile matching the top profile of the first of the at least one bearing rail, the second bearing rail being longitudinally aligned with the second front running belt pulley and the second rear running belt pulley;

the running belt comprises a first endless belt and a second endless belt, wherein the first endless belt is supported by the at least one front running belt pulley, the first of the at least one bearing rail, and the at least one rear running belt pulley, and wherein the second endless belt is supported by the second front running belt pulley, the second bearing rail, and the second rear running belt pulley; and the plurality of laterally extending slats extend between the first endless belt and the second endless belt.

15. The manually operated treadmill of claim 14, wherein the rear portion of the at least one bearing rail is positioned and shaped to provide a smooth transition for the running belt from the at least one bearing rail onto the at least one rear running belt pulley.

16. The manually operated treadmill of claim 11, wherein the safety device comprises a one-way bearing.

* * * * *

UNITED STATES PATENT AND TRADEMARK OFFICE

CERTIFICATE OF CORRECTION

PATENT NO. : 8,986,169 B2
APPLICATION NO. : 14/243716
DATED : March 24, 2015
INVENTOR(S) : Douglas G. Bayerlein et al.

It is certified that error appears in the above-identified patent and that said Letters Patent is hereby corrected as shown below:

Claims

Claim 11:
In column 33, line 56, please replace the word "a" following the phrase "the frame" with the word "and".

In column 33, line 57, please insert the word --a-- before the word "distance".

In column 33, line 63, please replace the phrase "front portion" with the phrase "front belt portion".

In column 34, line 20, please replace the phrase "profile rear portion" with the phrase "rear profile portion".

Claim 15:
In column 34, line 58, please replace the phrase "rear portion" with the phrase "rear profile portion".

Signed and Sealed this
Twenty-ninth Day of March, 2016

Michelle K. Lee

Michelle K. Lee
*Director of the United States Patent and Trademark Office*